US006279325B1

(12) United States Patent
Sekiya et al.

(10) Patent No.: US 6,279,325 B1
(45) Date of Patent: Aug. 28, 2001

(54) STIRLING DEVICE

(75) Inventors: Hiroshi Sekiya; Nobuo Koumoto; Eiji Fukuda; Takashi Inoue; Hirotaka Kakinuma; Takeo Komatsubara, all of Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/432,519

(22) Filed: Nov. 2, 1999

(30) Foreign Application Priority Data

| | | |
|---|---|---|
| Nov. 2, 1998 | (JP) | 10-311801 |
| Nov. 2, 1998 | (JP) | 10-311804 |
| Nov. 2, 1998 | (JP) | 10-311805 |
| Dec. 22, 1998 | (JP) | 10-365364 |
| Dec. 22, 1998 | (JP) | 10-365371 |

(51) Int. Cl.[7] ..... F25B 1/00
(52) U.S. Cl. ..... 62/6; 62/520
(58) Field of Search ..... 62/6; 60/520

(56) References Cited

U.S. PATENT DOCUMENTS

| | | | | |
|---|---|---|---|---|
| 4,693,736 | * | 9/1987 | Klusmier | 62/6 |
| 4,879,876 | * | 11/1989 | Robertson | 62/6 |
| 4,949,546 | * | 8/1990 | Klusmier | 62/6 |
| 4,967,572 | * | 11/1990 | Strasser | 62/6 |
| 5,284,022 | * | 2/1994 | Chung | 62/6 |
| 5,293,748 | * | 3/1994 | Flanigan | 62/6 |
| 5,505,047 | * | 4/1996 | Hirose et al. | 62/6 |

FOREIGN PATENT DOCUMENTS

| | | |
|---|---|---|
| 11-223398 | 8/1999 | (JP) . |
| 11-223399 | 8/1999 | (JP) . |
| 11-223400 | 8/1999 | (JP) . |
| 11-223404 | 8/1999 | (JP) . |
| 11-230629 | 8/1999 | (JP) . |

* cited by examiner

*Primary Examiner*—Ronald Capossela
(74) *Attorney, Agent, or Firm*—Darby & Darby

(57) ABSTRACT

There is disclosed a Stirling cycle refrigerator in which oil rising is prevented, and an adverse influence onto oil sealing bellows by a pressure rise accompanying the temperature rise of the crank chamber is prevented. The oil sealing bellows are disposed between a space in a housing and compression and expansion cylinders, and a buffer tank provided with the pressure adjusting bellows is disposed between a space on the back surface side of the compression and expansion pistons and the space in the housing, so that the pressure rise in the housing and the pressure fluctuation of the space are absorbed.

39 Claims, 30 Drawing Sheets

(a)

(b)

(c)

(b)

(c)
ENLARGED VIEW OF MAIN PART C (a)

(b)

(c)

ENLARGED VIEW OF MAIN PART D (a)

455 TEMPERATURE ADJUSTMENT DEVICE

STIRLING DEVICE

BACKGROUND OF THE INVENTION (I) Field of the Invention

The present invention relates to a Stirling cycle device which can be used for refrigerating or cooling in all industrial fields of industrial apparatuses of food distribution, environmental test, medicine, biological industry, semiconductor manufacture, and the like, or household apparatuses.

(ii) Description of the Related Art

In recent years, a Stirling cycle refrigerator, hereafter referred to generallt as "refrigerator", has been highlighted as a refrigerating device using a substitute for Freon in earth environmental problems, or as a refrigerator whose operation temperature is in a broader range than that of a conventional cooling device. Therefore, the refrigerator can be applied to the apparatuses utilizing cooling heat for business or household use such as a freezer, a refrigerator, and a throw-in type cooler, and the cooling heat utilizing apparatuses of all industrial fields such as a low-temperature fluid circulator, a low-temperature isothermal unit, an isothermal tank, a heat shock test device, a freezing drier, a thermal property test device, a blood/cell storage-device, a cold cooler, and other various cooling heat devices. Furthermore, the refrigerator is compact, high in result coefficient, and excellent in energy efficiency.

FIG. 1 is an entire schematic view of a conventional general Stirling cycle refrigerator 1, and in a housing 2, crank portions 5, 6 of a crank shaft 4 operated by a motor 3 are connected to a compression piston rod 9 and an expansion piston rod 10 via cross guide heads 7, 8. Via these compression piston rod 9 and expansion piston rod 10, a compression piston 11 and an expansion piston 12 reciprocate with a phase difference in a compression cylinder 13 and an expansion cylinder 14, respectively. Thereby, operating gas is compressed and expanded. Additionally, by a radiating heat exchanger (high-temperature side heat exchanger) 18 and a cooling heat exchanger (low-temperature side heat exchanger) 19 disposed between a high-temperature chamber (compression chamber) 15 of the compression cylinder 13 and a low-temperature chamber (expansion chamber) 16 of the expansion cylinder 14 via a regenerator 17, heat exchange is performed between a radiating refrigerant and a cooling heat refrigerant, and the operating gas.

Here, there arises a problem, which is so-called oil rising, that oil or oil mist rises from a crank chamber along the piston rods 9, 10. For the oil rising, after entering the compression and expansion cylinders, the oil or oil mist adheres to inner surfaces, or is carbonized by heat so that the performance and durability of the refrigerator are remarkably deteriorated. To solve the oil rising problem, in a conventional art, the compression piston rod 9 and the expansion piston rod 10 are sealed by oil seals 20, 21.

Additionally, the oil seals are variously developed in structures and materials, but they are not necessarily sufficient in sealing performance or durability. Moreover, a roll socks type seal system has been proposed, whose durability cannot be said to be sufficient in the present situation.

Moreover, when the Stirling cycle refrigerator is operated, temperature rises, and inner pressure rises in a crank chamber 26. The pressure rise of the crank chamber applies a mechanical burden to the oil seal, and causes deterioration. There arises another problem that the pressure promotes the oil rising, and adversely affects the performance.

Moreover, the reciprocating movement of the compression and expansion pistons generates a pressure fluctuation on the side of a back surface, and adversely affects the oil seals.

An object of the present invention is to solve problems peculiar to the Stirling cycle refrigerator comprising the above-described refrigerator, and the problems of the present invention are as follows:

(1) The oil rising is prevented, long-life piston rod oil sealing bellows are realized, and the performance and life of the Refrigerator are enhanced.

(2) For the pressure rise accompanying the temperature rise of the crank chamber, even when a general oil seal is employed, deterioration or oil rising cannot be prevented. Moreover, even when the oil sealing bellows are employed, inner and outer pressure differences are generated to adversely affect the bellows themselves and the performance of the refrigerator. The pressure rise accompanying the temperature rise of the crank chamber is solved by employing a buffer tank which has pressure adjusting bellows.

(3) The problem of pressure fluctuation generated on the side of the back surface of the compressing or expanding piston which adversely affects the oil seal or the refrigerator performance is solved by employing the buffer tank provided with or without the pressure adjusting bellows.

(4) The problem of the pressure fluctuation generated on the back surface side of the piston is solved by utilizing a space in the housing having the crank chamber. Specifically, the problem is solved by connecting the back surface side of the piston to the space in the housing having the crank chamber via an oil trapping device. In this case, a constricting device for adjusting the oil trapping device may also be used together (arranged in series for use).

SUMMARY OF THE INVENTION

To solve the problems, according to the present invention, there is provided a Stirling cycle refrigerator, comprising: a housing having a crank chamber; a cylinder disposed above and adjacent to the crank chamber; a piston for reciprocating in the cylinder to compress or expand operating gas, or a displacer; a piston rod operatively connected to a crank in the crank chamber and having one end connected to the piston, or the displacer; and an oil seal disposed in an opening of a top of the crank chamber through which the piston rod is passed. In the Stirling cycle refrigerator, the oil seal comprises oil sealing bellows whose tip end is fixed to the piston rod in the cylinder and whose base end is fixed to a peripheral edge of the opening of the top of the crank chamber provided with the piston rod passed therethrough. By disposing the oil sealing bellows, oil is inhibited from entering the cylinder via a space in the housing.

Between a space on the side of a back surface of the piston for compressing or expanding the operating gas and the space in the housing, a buffer tank for absorbing a pressure fluctuation in the space on the back surface side, and a pressure rise in the housing is connected via connecting means. Inside the buffer tank, pressure adjusting bellows are disposed to divide the buffer tank into a chamber on the side of an opening of the pressure adjusting bellows and a chamber on the side of a closing wall, and the chamber on the opening side and the chamber on the closing wall side may be connected to either one of the space on the back surface side of the piston and the space in the housing.

Additionally, the space on the back surface side of the piston for compressing-or expanding the operating gas and the space in the housing may be connected via an oil trapping device to absorb the pressure fluctuation of the space on the back surface side.

Moreover, in the space on the back surface side of the piston for compressing or expanding the operating gas, the buffer tank for absorbing the pressure fluctuation of the space on the back surface side is connected via the connecting means. Between the buffer tank and the space in the housing, the oil trapping device, or the oil trapping device connected to a pressure adjusting constriction device may be disposed, so that pressure adjustment can be performed in the space on the back surface side of the piston for compressing or expanding the operating gas, and the space in the housing.

Furthermore, as the oil seal, in addition to the oil sealing bellows, an annular pressure-resistant oil seal pressed into contact with the piston rod is disposed in the opening of the top of the crank chamber. Between the space on the back surface side of the piston for compressing or expanding the operating gas, and a seal chamber formed by the oil sealing bellows, the buffer tank for reducing an invalid pressure fluctuation generated on the back surface side of the piston and an invalid pressure fluctuation generated in the seal chamber is connected via connecting means. Inside the buffer tank, the pressure adjusting bellows, are disposed to divide the buffer tank into the chamber on the side of the opening of the pressure adjusting bellows and the chamber on the side of the closing wall, and the chamber on the opening side and the chamber on the closing wall side may be connected to either the space on the back surface side of the piston or the seal chamber.

Furthermore, to solve the above-described problems, according to the present invention, there is provided a Stirling cycle refrigerator, comprising: a housing having a crank chamber; a cylinder disposed above and adjacent to the crank chamber; a piston for reciprocating in the cylinder to compress or expand operating gas, or a displacer; a piston rod operatively connected to a crank in the crank chamber and having one end connected to the piston, or the displacer; and an oil seal disposed in an opening of a top of the crank chamber through which the piston rod is passed. In the Stirling cycle refrigerator, between a space on the side of a back surface of the piston, and a space in the housing, a buffer tank for absorbing a pressure fluctuation in the space on the back surface side and a pressure rise in the housing is connected via connecting means. Inside the buffer tank, pressure adjusting bellows are disposed to divide the buffer tank into a chamber on the side of an opening of the pressure adjusting bellows, and a chamber on the side of a closing wall, and the chamber on the opening side and the chamber on the closing wall side are connected to either the space on the back surface side of the piston or the space in the housing.

Additionally, to solve the problems, according to the present invention, there is provided a Stirling cycle refrigerator, comprising: a housing having a crank chamber; a cylinder disposed above and adjacent to the crank chamber; a piston for reciprocating in the cylinder to compress or expand operating gas, or a displacer; a piston rod operatively connected to a crank in the crank chamber and having one end connected to the piston, or the displacer; and an oil seal disposed in an opening of a top of the crank chamber through which the piston rod is passed. In the Stirling cycle refrigerator, between a space on the side of a back surface of the piston, and a space in the housing, a buffer tank for absorbing a pressure fluctuation in the space on the back surface side and a pressure rise in the housing is connected via connecting means, and between the buffer tank and the space in the housing, an oil trapping device, or the oil trapping device connected to a pressure adjusting constriction device is disposed, so that pressure adjustment can be performed in the space on the back surface side of the piston for compressing or expanding the operating gas and the space in the housing.

Furthermore, to solve the above-described problems, according to the present invention, there is provided a Stirling cycle refrigerator, comprising: a housing having a crank chamber; a cylinder disposed above and adjacent to the crank chamber; a piston for reciprocating in-the cylinder to compress or expand operating gas, or a displacer; a piston rod operatively connected to a crank in the crank chamber and having one end connected to the piston, or the displacer; and an oil seal disposed in an opening of a top of the crank chamber through which the piston rod is passed. In the Stirling cycle refrigerator, a space on the side of a back surface of the piston, and a space in the housing are connected via an oil trapping device in order to absorb a pressure fluctuation of the space on the back surface side.

Additionally, the pressure adjusting bellows may be constituted of one set of bellows, or a pair of opposite type bellows opposite to each other.

Moreover, a compression force may be applied to the closing wall of the pressure adjusting bellows by a spring.

Furthermore, the pressure adjusting bellows are guided to the buffer tank by a guide member, and are constituted to smoothly expand and contract without deflecting.

Additionally, one or two or more buffer tanks may be disposed.

Moreover, the operating gas of the Stirling cycle refrigerator is nitrogen, helium or hydrogen, and the cooling heat refrigerant is any one gas selected from the group consisting of ethyl alcohol, HFE, PFC, PFG, nitrogen and helium.

Furthermore, the Stirling cycle refrigerator may be applied as the constitution of a refrigerating device comprising a compression cylinder having a compression piston, and an expansion cylinder having an expansion piston or a displacer, in which the compression piston and the expansion piston or the displacer reciprocate with a phase difference.

Additionally, the Stirling cycle refrigerator may be applied as a Stirling cycle refrigerator, or a Stirling engine.

Moreover, the Stirling cycle refrigerator of the present invention comprises a cylinder block provided with a cylindrical top heat exchange housing having a top wall and a side wall, and an inner cylinder disposed in the top heat exchange housing in which the piston or the displacer slides. In an inner peripheral face on the side of a tip end of the top heat exchange housing, a linear fine groove in an axial direction is formed to form an operating gas channel with an outer peripheral face of the inner cylinder. In the inner peripheral face on the side of a base end of the top heat exchange housing, an annular recess is formed to form a channel for an operating gas regenerator with the outer peripheral face of the inner cylinder. The top heat exchange housing is formed by lost wax casting.

Furthermore, according to the present invention, the Stirling cycle refrigerator is provided with a cylinder block having an inner cylinder in which the piston or the displacer slides. Outside the inner cylinder, a cylindrical heat exchanger is disposed which comprises an annular heat exchange housing and a heat exchanger body inserted/fixed inside the housing. For the heat exchanger body, in an outer peripheral face, a heat exchanging fin is formed, and in an inner peripheral face, a linear fine groove in an axial direction is formed to form an operating gas channel with an outer peripheral face of the inner cylinder. A space between the annular heat exchange housing and the heat exchanger body is formed as a refrigerant path. In the annular heat exchange housing a refrigerant inlet and a refrigerant outlet are formed so that the refrigerant path is connected. The annular heat exchange housing is formed by lost wax casting or iron casting, and the heat exchanger body is formed by the lost wax casting.

Additionally, according to the present invention, there is provided a Stirling cycle refrigerator which comprises a cylinder block provided with a cylindrical top heat exchange housing having a top wall and a side wall, and an inner cylinder disposed in the top heat exchange housing in which a piston or a displacer slides. In an inner peripheral face on the side of a tip end of the top heat exchange housing, a linear fine groove in an axial direction is formed to form an operating gas channel with an outer peripheral face of the inner cylinder. In the inner peripheral face on the side of a base end of the top heat exchange housing, an annular recess is formed to form a channel for an operating gas regenerator with the outer peripheral face of the inner cylinder. Outside the inner cylinder, a cylindrical heat exchanger is disposed which comprises an annular heat exchange housing and a heat exchanger body inserted/flexed inside the housing. For the heat exchanger body, in an-outer peripheral face, a heat exchanging fin is formed, and in an inner peripheral face, a linear fine groove in an axial direction is formed to form the operating gas channel with the outer peripheral face of the inner cylinder. A space between the annular heat exchange housing and the heat exchanger body is formed as a refrigerant path, and a refrigerant inlet and a refrigerant outlet are formed in the annular heat exchange housing so that the refrigerant path is connected. The top heat exchange housing and the heat exchanger body are formed by lost wax casting, or the annular heat exchange housing is formed by the lost wax casting or, iron casting.

The top heat exchange housing has in a tip end side outer peripheral face a fin formed integrally with the top heat exchange housing, or a fin separately formed and attached later.

Moreover, in the present invention, the Stirling cycle refrigerator comprises a Stirling cycle refrigerator sealing the operating gas, and having a cold head and a radiating heat exchanger; a cooling heat refrigerant pipe line able to be connected to a cooling heat utilizing apparatus for circulating a cooling heat refrigerant from the cold head between the refrigerator and the cooling heat utilizing apparatus; and a cooling heat refrigerant isothermal fluid storage tank disposed midway in the cooling heat refrigerant pipe line for storing the cooling heat refrigerant, so that a temperature fluctuation of the cooling heat refrigerant by an operating state of the Refrigerator is prevented from directly influencing a cooling temperature of the cooling heat utilizing apparatus.

Furthermore, in the present invention, the Stirling cycle refrigerator comprises a refrigerator sealing the operating gas, and having a cold head and a radiating heat exchanger; a cooling heat refrigerant pipe line having both ends connected to the cold head for circulating a cooling heat refrigerant cooled in the cold head; a secondary cooling heat refrigerant isothermal fluid storage tank in which a secondary cooling heat refrigerant is accommodated and a heat exchange section of the cooling heat refrigerant pipe line is interposed so that the heat exchange section contacts the secondary cooling heat refrigerant; and a secondary cooling heat refrigerant pipe line having both ends connected to the secondary cooling heat refrigerant isothermal fluid storage tank and connected to a cooling heat utilizing apparatus for circulating the secondary cooling heat refrigerant between the secondary cooling heat refrigerant isothermal fluid storage tank and the cooling heat utilizing apparatus, so that a temperature fluctuation of the cooling heat refrigerant by an operating state of the Refrigerator is prevented from directly influencing a cooling temperature of the cooling heat utilizing apparatus.

Additionally, in the present invention, the Stirling cycle device comprises a Refrigerator sealing the operating gas, and having a cold head and a radiating heat exchanger; a cooling heat refrigerant pipe line for passing a cooling heat refrigerant cooled in the cold head, connected to a cooling heat utilizing apparatus, and disposed for circulating the cooling heat refrigerant between the Refrigerator and the cooling heat utilizing apparatus; and a cooling heat refrigerant isothermal fluid storage tank in which the cooling heat refrigerant is accommodated, the cold head is passed from a bottom part, and the stored cooling heat refrigerant is cooled, so that a temperature fluctuation of the cooling heat refrigerant by an operating state of the Refrigerator is prevented from directly influencing a cooling temperature of the cooling heat utilizing apparatus.

Moreover, there is provided a temperature adjustment device which performs an operation control of the Refrigerator and/or a control of an electric heater disposed in the cooling heat refrigerant isothermal fluid storage tank to perform a temperature control.

Furthermore, a motor of the Refrigerator is controlled to rotate in reverse so that temperature adjustment, high-temperature heating, or defrosting is performed.

Additionally, by rotatably disposing an agitating blade in the cooling heat refrigerant isothermal fluid storage tank, a temperature difference of the cooling heat refrigerant in the cooling heat refrigerant isothermal fluid storage tank is prevented from being generated.

Moreover, according to the present invention, there is provided a Stirling cycle device, comprising a Refrigerator sealing the operating gas, and having a cold head for cooling a cooling heat refrigerant and a radiating heat exchanger; a thermal property test tank for storing a test object to be subjected to a thermal property test, and cooled by the cooling heat refrigerant; and a cooling heat refrigerant pipe line for passing the cooling heat refrigerant cooled by the cold head in the thermal property test tank and circulating the cooling heat refrigerant between the cold head and the thermal property test tank, in which by rotating the Refrigerator forward or in reverse to cool or heat the cooling heat refrigerant, heat shock is applied to the test object and the thermal property test is performed.

Furthermore, according to the present invention, there is provided a Stirling device, comprising a Refrigerator sealing operating gas, and having a cold head for cooling a cooling heat refrigerant and a radiating heat exchanger; a thermal property test tank for storing a test object to be subjected to a thermal property test, and cooled by, the cooling heat refrigerant; and a cooling heat refrigerant pipe line for passing the cooling heat refrigerant cooled by the cold head so that the cooling heat refrigerant flows around the thermal property test tank and circulates between the cold head and the thermal property test tank, in which by rotating the Refrigerator forward or in reverse to cool or-heat the cooling heat refrigerant, heat shock is applied to the test-object and the thermal property test is performed.

Additionally, according to the present invention, there is provided a Stirling cycle device, comprising a Refrigerator sealing the operating gas, and having a cold head for cooling a cooling heat refrigerant and a radiating heat exchanger; and a thermal property test tank in which a test object to be subjected to a thermal property test is accommodated, and the cold head is disposed to pass through from a bottom part, in which by rotating the Refrigerator forward or in reverse to cool or heat the cooling heat refrigerant, heat shock is applied to the test object and the thermal property test is performed.

In the thermal property test tank, a storage case or a stacking shelf for storing the test object may be disposed.

Air, nitrogen or helium is circulated as the cooling heat refrigerant, and the thermal property test tank is provided with the storage case with a vent hole formed therein for storing the test object in the storage case, or may be provided with no storage case for storing the test object.

A temperature adjustment device for operating/controlling the Refrigerator to perform temperature control may be disposed.

Any one of the thermal property test tank, the cold head and the cooling heat refrigerant pipe line is provided with an electric heater so that a precise temperature control of the thermal property test tank, defrosting, and the like can be performed. Additionally, by performing control to rotate the motor of the Refrigerator in reverse, the temperature of the thermal property test tank can be raised.

Moreover, according to the present invention, there is provided a Stirling cycle device, comprising: a Refrigerator sealing operating gas, and having a cold head for cooling a cooling heat refrigerant and a radiating heat exchanger; a freezing/drying tank in which a heat exchanging coil is disposed in an outer periphery and a material to be dried can be accommodated; and a cooling heat refrigerant pipe line for circulating the cooling heat refrigerant cooled by the cold head between the cold head and the heat exchanging coil, in which by operating the Refrigerator, passing the cooling heat refrigerant through the heat exchanging coil, and freezing/drying the freezing/drying tank, the material to be dried is dried.

Furthermore, according to the present invention, there is provided a Stirling cycle device, comprising: a Refrigerator sealing operating gas, and having a cold head for cooling a cooling heat refrigerant and a radiating heat exchanger; a freezing/drying tank in which a heat exchanging coil is disposed and a material to be dried can be accommodated; and a cooling heat refrigerant pipe line for circulating the cooling heat refrigerant cooled by the cold head between the cold head and the heat exchanging coil, in which by operating the Refrigerator, passing the cooling heat refrigerant through the heat exchanging coil, and freezing/drying the freezing/drying tank, the material to be dried is dried.

Additionally, according to the present invention, there is provided a Stirling cycle device, comprising: a Refrigerator sealing operating gas, and having a cold head for cooling a cooling heat refrigerant and a radiating heat exchanger; a freezing/drying tank in which the cooling heat refrigerant is introduced and a material to be dried can be accommodated; and a cooling heat refrigerant pipe line for circulating the cooling heat refrigerant cooled by the cold head between the cold head and the inside of the freezing/drying tank, in which by operating the Refrigerator, introducing the cooling heat refrigerant into the freezing/drying tank, and performing freezing/drying, the material to be dried is dried.

Moreover, according to the present invention, there is provided a Stirling cycle device, comprising: a Refrigerator sealing operating gas, and having a cold head for cooling a cooling heat refrigerant and,a radiating heat exchanger; and a freezing/drying tank in which the cold head is passed through from a bottom part, and a material to be dried can be accommodated, in which by operating the Refrigerator, and performing freezing/drying, the material to be dried is dried.

Furthermore, a temperature adjustment device for operating/controlling the Refrigerator to perform temperature control may be disposed.

Additionally, by performing control to rotate the motor of the Refrigerator in reverse, the temperature of the freezing/drying tank can be raised.

DETAILED DESCRIPTION OF THE PREFERRED EMBODIMENTS

[First Embodiment]

Figure 1:
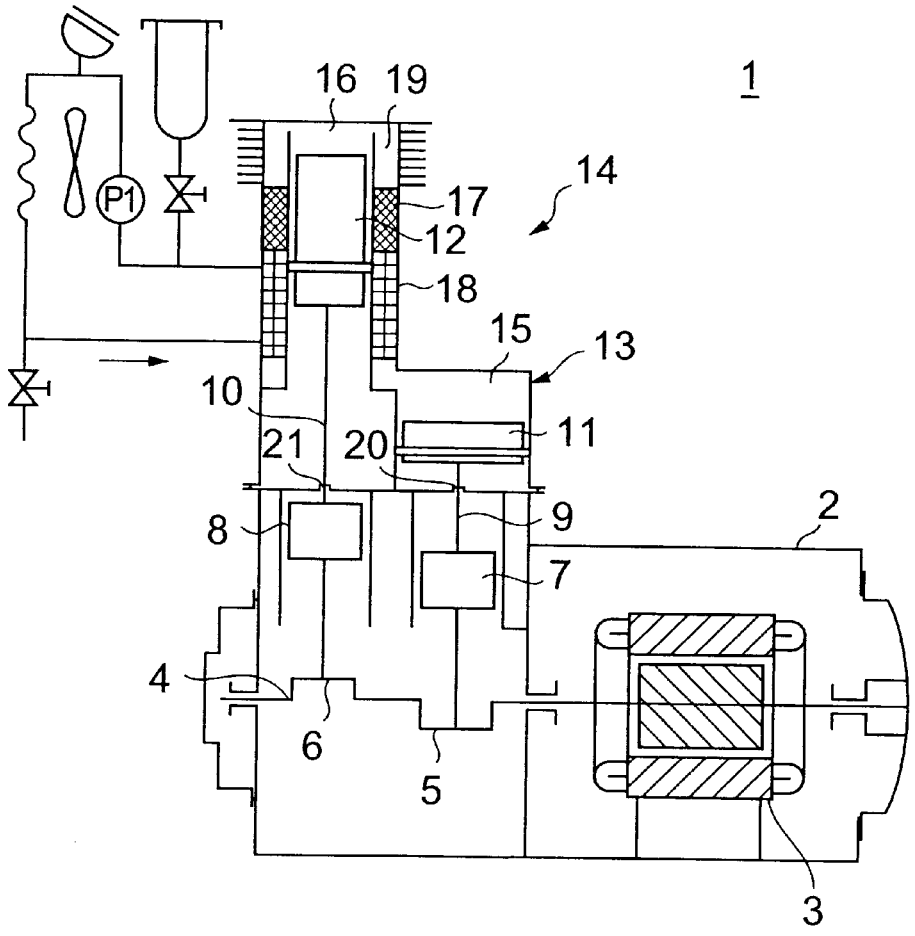
FIG.1 PRIOR ART
FIG. 1 is a diagram showing the entire conventional Stirling cycle refrigerator.
Figure 2:
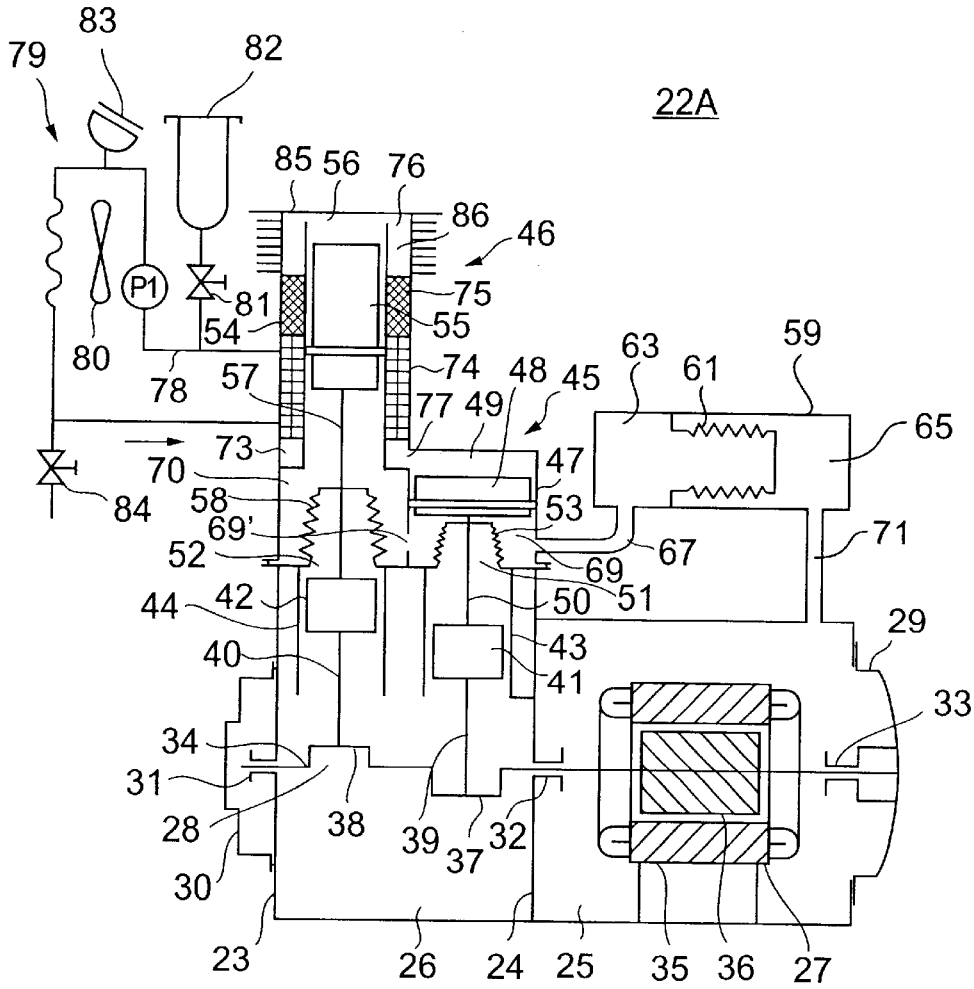
FIG. 2 is a diagram showing a first embodiment of a Stirling cycle refrigerator according to the present invention.

Embodiments of a Stirling cycle device of the present invention will be described hereinafter based on first to ninth embodiments with respect to a Stirling cycle refrigerator with reference to the drawings. FIG. 2 shows a first embodiment of the refrigerator according to the present invention. For an outline of a refrigerator 22 of the first embodiment, a first characteristic lies in a constitution provided with oil sealing bellows for preventing oil rising, and a further characteristic lies in a constitution in which a buffer tank provided with a pressure adjusting bellows connected to a crank chamber is disposed, and with respect to the oil sealing bellows, a pressure rise in a space in a housing resulting from a temperature rise of the crank chamber, as well as a pressure fluctuation on the side of a back surface of a compression piston or an expanding piston are absorbed.

This respect will be described in detail. In FIG. 2, a housing 23 of a Refrigerator 22A is formed of a cast material. The inside of the housing 23 is divided into a motor chamber 25 and a crank chamber 26 by a partition wall 24, the motor chamber 25 is provided with a motor 27 which can rotate forward or in reverse, and the crank chamber 26 is provided with a rotation/reciprocation converting mechanism 28 which converts the rotation of the motor 27 to reciprocation. The motor chamber 25 and the crank chamber 26 are closed with lids 29, 30, respectively.

In the housing 23, a crank shaft 34 is rotatably passed through the partition wall 24, and supported by bearings 31 to 33. The motor 27 is constituted of a stator 35 and a rotor 36, and the crank shaft 34 is fixed to the middle of the rotor 36.

The rotation/reciprocation converting mechanism 28 is constituted of crank sections 37, 38 of the crank shaft 34 extended in the crank chamber 26, connecting rods 39, 40 connected to the crank sections 37, 38, and cross guide heads 41, 42 attached to the tip ends of the connecting rods, and functions as drive transmission means of the Refrigerator 22A.

The cross guide heads 41, 42 are reciprocally disposed in cross guide liners 43, 44 disposed on the cylinder inner wall of the housing 23. The crank sections 37, 38 are formed with a phase difference so that the crank section 38 moves prior to the crank section 37 when the motor 27 rotates forward. For the phase difference, a phase difference of about 90 degrees is usually employed.

On the crank chamber 26 of the housing 23 of the Refrigerator 22A, there are provided a compression cylinder 45 and an expansion cylinder 46. In the compression cylinder 45, expansion cylinder 46 and housing 23, operating gas such as helium, hydrogen, and nitrogen is sealed.

The compression cylinder 45 has a compression cylinder block 47 fixed to the housing 23 with bolts, and the like, and in the space of the compression cylinder block 47 a compression piston 48 reciprocates. A high-temperature chamber (compression space) 49 is formed above the space, in which the operating gas is compressed to provide a high temperature.

One end of a compression piston rod 50 is fixed to the compression piston 48, and the other end thereof is rotatably connected to the cross guide head 41. To seal an opening 51 in the upper section of the housing 23, the upper end of oil sealing bellows 53 is fixed to the compression piston rod 50, and the lower end thereof is fixed to the peripheral edge of the opening 51.

Thereby, the compression cylinder 45 and the crank chamber 26 of the housing 23 are completely sealed, so that oil is completely prevented from-going into the compression cylinder 45 from the crank chamber 26. In the oil sealing bellows 53, molded bellows integrally molded by press processing metal materials, or welded bellows assembled by welding are used.

Since the sliding direction of the reciprocating compression piston 48 is reversed at a top dead point and a lower dead point, speed turns to zero. In the vicinity of the top dead point or the lower dead point, the speed is low, and the change amount of volume per unit time is small. During movement from the lower dead point to the top dead point, or from the top dead point to the lower dead point, the speed reaches maximum at each midpoint, and the volume change amount by the movement of the piston per unit time is also maximized.

On the other hand, the expansion cylinder 46 is positioned slightly above the compression cylinder 45, and has an expansion cylinder block 54 fixed with bolts, and the like to the housing 23. In the space of the expansion cylinder block 54, an expansion piston 55 provided with a piston ring reciprocates/slides. A low-temperature (expansion space) 56 is formed above the space, in which the operating gas is expanded to provide a low temperature. The expansion piston 55 moves prior to the compression piston 48 by the phase of about 90 degrees.

One end of an expansion piston rod 57 is fixed to the expansion piston 55, and the other end thereof is rotatably connected to the cross guide head 42. To seal an upper opening 52 in the housing 23, the upper end of oil sealing bellows 58 is fixed to the expansion piston rod 57, and the lower end of the oil-sealing bellows 58 is fixed to the peripheral edge of the opening 52 of the housing 23.

Thereby, the expansion cylinder 46 and the crank chamber 26 are completely sealed, so that oil is completely prevented from going into the expansion cylinder 46 from the crank chamber 26 along the expansion piston rod 57. In the oil sealing bellows 58, the bellows similar to those for the compression cylinder are used.

In the Refrigerator 22A, a buffer tank 59 is disposed, and in the buffer tank 59, pressure adjusting bellows 61 expanding and contracting in an axial direction are disposed. By the pressure adjusting bellows 61, the buffer tank 59 is divided into a chamber 63 on the side of the opening of the pressure adjusting bellows 61 and a chamber 65 on the side of the closing wall of the pressure adjusting bellows 61.

The chamber 63 on the opening side of the pressure adjusting bellows 61 is connected to a space 69 on the side of the back surface of the compression piston 48 of the compression cylinder. Additionally, a connecting hole 69' is formed in the partition wall of the chamber 69 and a space 70 on the back surface side of the expansion piston 55 of the expansion cylinder, so that two spaces 69, 70 are interconnected. The chamber 65 on the closing wall side of the pressure adjusting bellows 61 is connected via a pipe 71 to the motor chamber 25 and the crank chamber 26 of the housing 23 (in this respect, although the motor chamber 25 and the crank chamber 26 are partitioned by the partition wall 24, they are not partitioned in a hermetic state, and are interconnected. Therefore, in the specification, the connection to the space in the housing 23 is mentioned.) In these pressure adjusting bellows 61, metal bellows, or resin or rubber bellows are used in the same manner as the oil sealing bellows 53, 58.

The expansion cylinder block 54 is provided with an annular manifold 73 connected to the high-temperature chamber (compression space) 49 of the compression cylinder 45, and further a radiating heat exchanger 74, regenerator 75 and cooling heat exchanger 76 are successively connected and disposed in an annular state. In the vicinity of the upper end of the compression cylinder block 45, a connecting hole 77 is formed, so that the high-temperature chamber (compression space) 49 and the low-temperature chamber (expansion space) 56 are successively interconnected via the connecting hole 77, manifold 73, radiating heat exchanger 74, regenerator 75 and cooling heat exchanger 76.

In the radiating heat exchanger 74, an annular type heat exchanger, such as a shell and tube type heat exchanger (heat exchanger in which a multiplicity of tubes for passing the operating gas into the annular heat exchanger are disposed in an axial direction to pass cooling water in a heat exchanger chamber and to cool the operating gas) is used.

The radiating heat exchanger 74 is connected to a radiator 79 via a cooling water circulating pipe line 78 and a cooling water pump PI to circulate the cooling water. The water subjected to heat exchange and heated in the radiating heat exchanger 74 is cooled by a cooling fan 80 of the radiator 79. The cooling water circulating pipe line 78 is connected to a water reservoir tank 82 via a reservoir valve 81. Moreover, the radiator 79 is connected to an air vent 83 and additionally to a drain valve 84.

The cooling heat exchanger 76 is formed in the upper section (cold head 85) of the expansion cylinder block 54. The cooling heat exchanger 76 therein has an operating gas channel 86, and a cooling fin is formed outside the exchanger. In the cooling heat exchanger, various structures are employed for purposes. For example, the exchanger may be structured by disposing a jacket wall in the top section of the expansion cylinder block 54, so that in the jacket wall, cooling heat refrigerants such as ethyl alcohol, HFE, PFC, PFG, nitrogen, and helium are circulated.

In the Refrigerator of the present invention, by disposing two pistons of compression cylinder 45, and expansion cylinder 46, and increasing the volume fluctuation of the space filled with the operating gas of the refrigerator, there can be provided the Refrigerator 22A which has a large refrigerating capability.

The action of the Stirling cycle refrigerator according to the embodiment of the present invention will next be described. The crank shaft 34 rotates forward by the motor 27, and the crank sections 37, 38 in the crank chamber 26 rotate deviating in phase from each other. The cross guide heads 41, 42 reciprocate in the cross guide liners 43, 44 via the connecting rods 39, 40 rotatably connected to the crank sections 37, 38. The compression piston 48 and the expansion piston 55 connected to the cross guide heads 41, 42 via the compression piston rod 50 and the expansion piston rod 57 reciprocate with a phase difference therebetween.

While the expansion piston 55 slowly moves ahead by about 90 degrees in the vicinity of the upper-dead point, the compression piston 48 rapidly moves toward the upper dead point in the vicinity of the middle to perform the compressing operation of the operating gas. The compressed operating gas flows into the radiating heat exchanger 74 through the connecting hole 77 and the manifold 73. The operating gas whose heat is radiated to cooling water in the radiating heat exchanger 74 is cooled in the regenerator 75, and flows into the low-temperature chamber (expansion space) 56 through the channel 86.

When the compression piston 48 slowly moves in the vicinity of the upper dead point, the expansion piston 55 rapidly moves toward the lower dead point, and the operating gas flowing into the low-temperature chamber (expansion space) 56 is rapidly expanded, thereby generating cooling heat. Thereby, the cold head 85 surrounding the expanded space is cooled to reach a low temperature.

When the expansion piston 55-moves to the upper dead point from the lower dead point, the compression piston 48 moves toward the lower dead point from the middle position, the operating gas flows into the regenerator 75 from the low-temperature chamber (expansion space) 56 through the channel 86, and the cooling heat of the operating gas is accumulated in the regenerator 75. The cooling heat accumulated in the regenerator 75 is reused for again cooling the operating gas fed from the high-temperature chamber 49 through the radiating heat exchanger 74 as described above.

The cooling heat of the cold head 85 is used in freezers, refrigerators, throw-in type coolers, low-temperature fluid circulators, low-temperature isothermal units for various thermal property tests, isothermal tanks, heat shock test devices, freezing driers, cold coolers, and other cooling heat utilizing apparatuses.

The cooling water subjected to heat exchange in the radiating heat exchanger 74 flows into the radiator 79 via the cooling water circulating pipe line 78, cooled by the cooling fan 80, and circulated to the radiating heat exchanger 74 again.

In the present invention, since the space between the compression piston rod 50 and the opening 51 is completely sealed by the oil sealing bellows 53, the oil or oil mist is completely prevented from rising along the compression piston rod 50 from the crank chamber 26 to enter the compression cylinder 45. Similarly, since the space between the expansion piston rod 57 and the opening 52 is completely sealed by the oil sealing bellows 58, the oil or oil mist is completely prevented from rising along the expansion piston rod 57 from the crank chamber 26 to enter the expansion cylinder 46.

Additionally, in the space of the housing 23, temperature rises during the operation of the Refrigerator, but with the temperature rise; the pressure of the space in the housing 23 rises. Moreover, pressure fluctuation is generated in the spaces 69, 70 on the back surface side of the compression piston 48 and the expansion piston 55. The pressure rise in the space of the housing 23 and the pressure fluctuations of the spaces 69, 70 are absorbed in the buffer tank 59. Particularly, for the pressure raised by the temperature rise in the space of the housing 23, when the pressure adjusting bellows 61 are disposed, the pressure of the chamber 65 rises via the pipe 71 to shrink the pressure adjusting bellows 61, so that the pressure rise is effectively absorbed.

The motor 27 of the Refrigerator 22A is rotated in reverse. Then, the compression piston 48 and the expansion piston 55 have a phase difference of about 90 degrees, and in completely reverse to the case where the motor 27 rotates forward, the compression piston 48 acts as the expansion piston 55, and the expansion piston 55 acts as the compression piston 48. Thereby, the operating gas in the expansion space of the expansion cylinder is compressed by the expansion piston 55 to generate heat. The reverse rotation is utilized when the temperature control operation is performed by the Refrigerator, or when the frost generated in the cooling heat exchanger of the cooling heat utilizing apparatus is removed.

By the reverse rotation, the expansion cylinder 46 also reaches a high temperature, thereby causing a problem so-called carbonization that the raised oil or oil mist is heated and carbonized to adhere into the cylinder. However, since the oil rising is completely prevented by the oil sealing bellows 58, no carbonization problem occurs.

[Second Embodiment]

Figure 3:
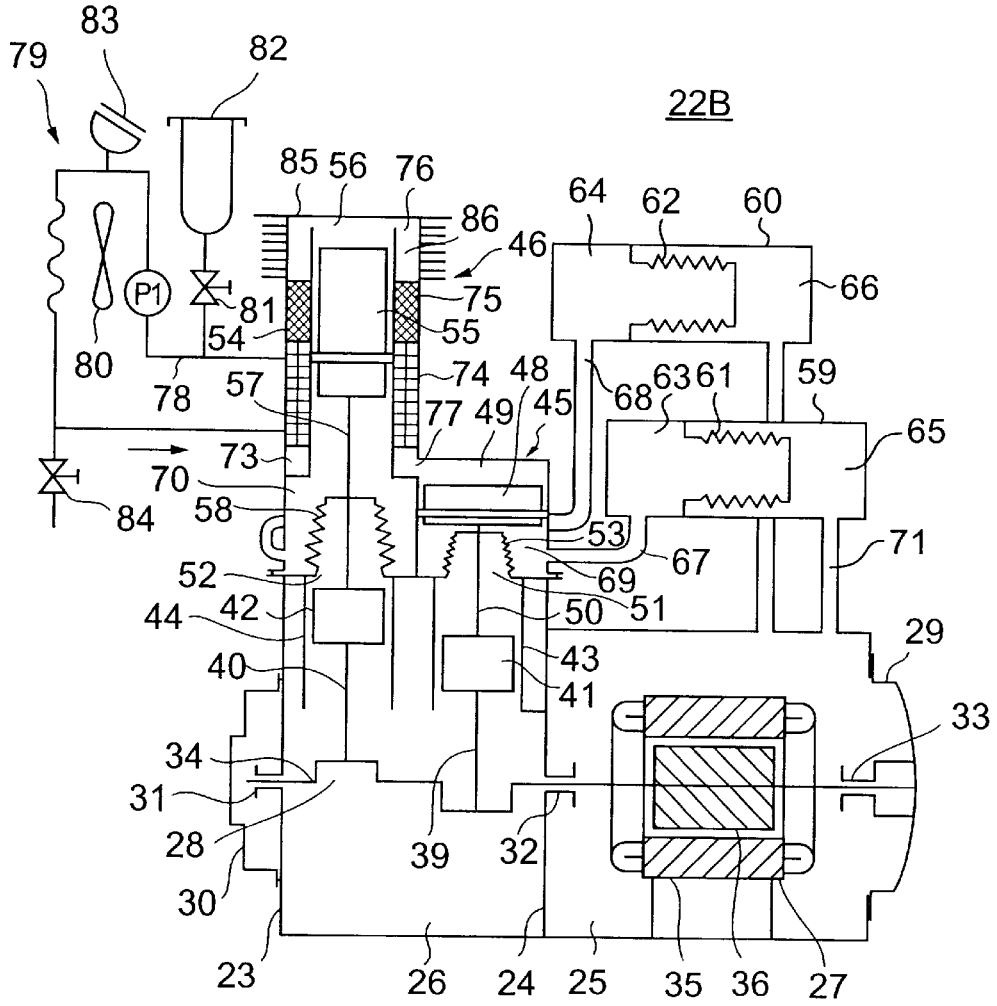
FIG. 3 is a diagram showing a second embodiment of the Stirling cycle refrigerator according to the present invention.

FIG. 3 shows a second embodiment of the Stirling cycle refrigerator according to the present invention. For the outline of a Refrigerator 22B of the embodiment, there are provided oil sealing bellows for preventing the oil rising. With respect to the oil sealing bellows, in order to prevent adverse influences by the pressure rise attributed to the temperature rise in the crank chamber and the pressure fluctuation of the spaces on the back surface side of the compression and expansion pistons, there are provided two buffer tanks with pressure adjusting bellows which are connected to the spaces on the back surface side and the space of the housing 23. The second embodiment is different from the first embodiment in that two buffer tanks are disposed, but is the same as the first embodiment in constitution and action in the other respects.

The respects will be described in detail. In FIG. 3, the Refrigerator 22B is provided with two buffer tanks 59, 60, and in the buffer tanks 59,-60, there are disposed pressure adjusting bellows 61, 62 which expand and contract in the axial direction. By the pressure adjusting bellows 61, 62, the buffer tanks 59, 60 are partitioned into chambers 63, 64 on the side of the openings of the pressure adjusting bellows and chambers 65, 66 on the side of the closing walls of the pressure adjusting bellows.

The chambers 63, 64 on the opening side of the pressure adjusting bellows are connected to the spaces 69, 70 on the back surface side of the compression piston 48 and the expansion piston 55 via pipes 67, 68. The chambers 65, 66 on the side of the closing walls of the pressure adjusting bellows are connected to the space of the housing 23 via pipes 71, 72. In the pressure adjusting bellows 61, 62, metal bellows are used in the same manner as the oil sealing bellows 53, 58.

The action of the second embodiment is substantially the same as that of the first embodiment, but in the second embodiment, the pressure rise accompanying the temperature rise in the space of the housing 23 and the pressure fluctuations of the spaces 69, 70 on the side of the back surface are absorbed by two buffer tanks 59, 60 provided with two sets of bellows.

[Third Embodiment]

Figure 4:
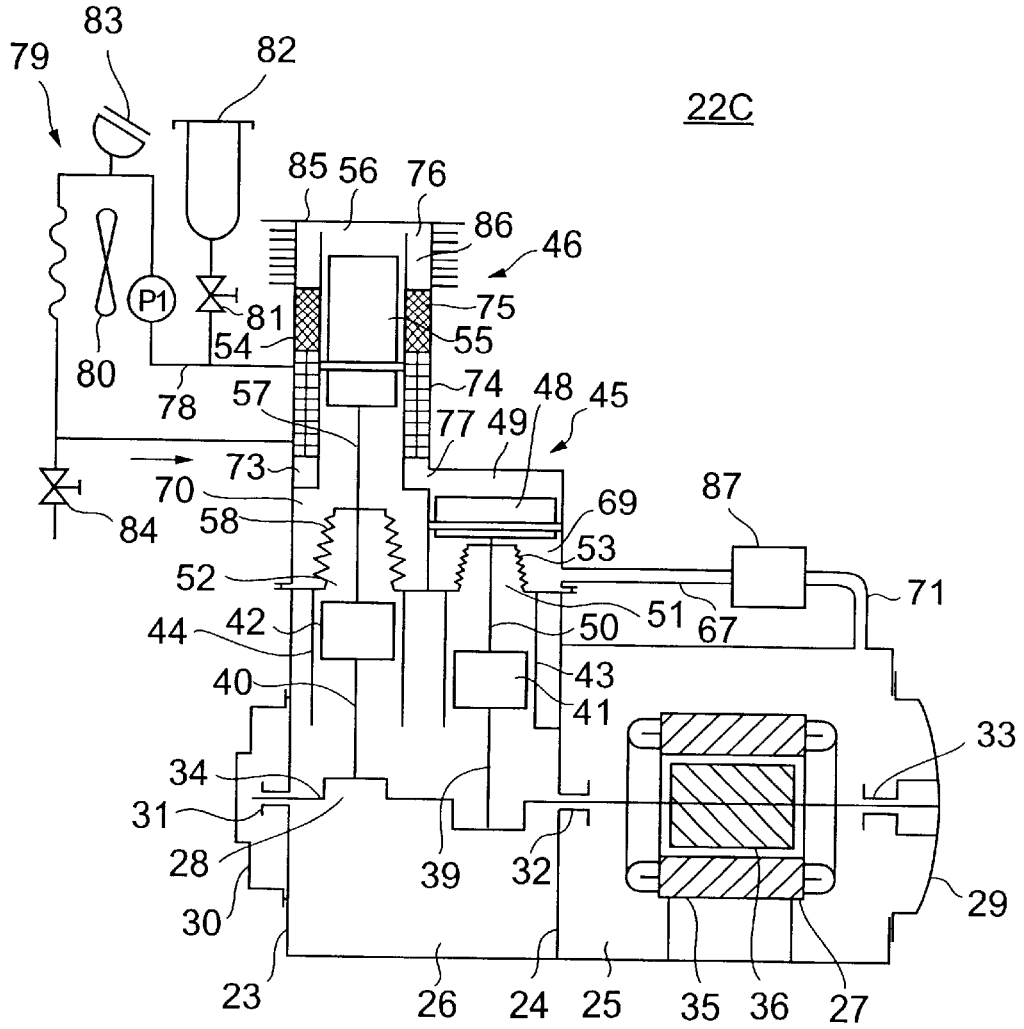
FIG. 4 is a diagram showing a third embodiment of the Stirling cycle refrigerator according to the present invention.

FIG. 4 is a diagram showing a third-embodiment of the Stirling cycle refrigerator according, to the, present invention. A Refrigerator 22C of the third embodiment is provided with oil sealing bellows for preventing the oil rising. By the pressure rise attributed to the temperature rise of the crank chamber, inner/outer pressure differences are generated in the oil sealing bellows, and pressure fluctuations are generated in the spaces 69, 70 on the piston back surface side of the compression piston 48 and the expansion piston 55. To prevent this, the back surface side spaces 69, 70 are connected to the space of the housing 23 via an oil trapping device (oil trap) 87.

Specifically, the spaces 69, 70 on the back surface side of the compression piston are connected to the space of the housing 23 via the pipe 67, oil trapping device 87 and pipe 71. The pressure fluctuations in the spaces on the piston back surface side of the compression piston 48 and the expansion piston 55 are absorbed in the space of the housing 23, so that the inner/outer pressure differences are prevented from being generated in the oil sealing bellows.

The oil trapping device 87 is disposed so that the oil or oil mist in the crank chamber is prevented from flowing into the spaces 69, 70 on the back surface side of the compression and expansion pistons, and oil filters and other appropriate structures are selected in accordance with the type or content of the oil which causes contamination (oil dirt). Moreover, in order to capture materials which cause the contamination, getter agents, and the like are utilized in accordance with the materials.

[Fourth Embodiment]

Figure 5:
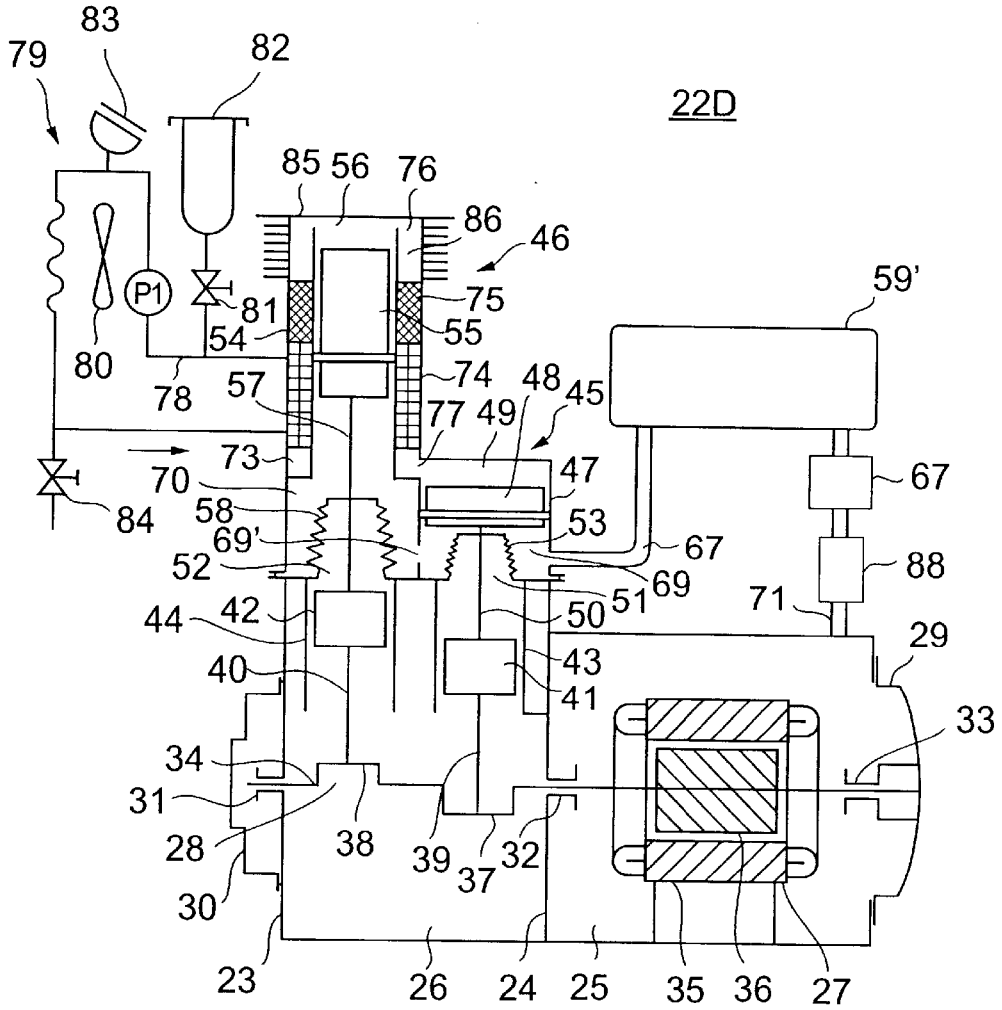
FIG. 5 is a diagram showing a fourth embodiment of the Stirling cycle refrigerator according to the present invention.

FIG. 5 is a diagram showing a fourth embodiment of the Stirling cycle refrigerator according to the present invention. A Refrigerator 22D of the fourth embodiment is provided with the oil sealing bellows 53, 58 for preventing the oil rising, and a buffer tank 59' (buffer tank provided with no pressure adjusting bellows) for absorbing the pressure fluctuations of the spaces 69, 70 on the back surface side of the compression piston 48 and the expansion piston 55. Furthermore, there is provided the oil trapping device 87 to prevent the oil or oil mist of the crank chamber from flowing into the spaces 69, 70 on the back surface side of the compression and expansion pistons.

Additionally, in the fourth embodiment, a pressure adjustment constricting device 88 is connected in series with the oil trapping device 87, and the pressure adjustment constricting device 88 is disposed if necessary for preventing the oil mist in the housing 23 from directly reaching the oil trapping device 87. Specifically, in the pressure adjustment constricting device 88, a capillary tube, a pressure adjusting valve, and the like are utilized.

[Fifth Embodiment]

FIG. 6 is a diagram showing a fifth embodiment of the Stirling cycle refrigerator according to the present invention. For the outline of the fifth embodiment, a Refrigerator 22E is applied to the case where the pressure rise caused by the temperature rise of the crank chamber 26 is small. Specifically, there are provided oil sealing bellows and a pressure-resistant oil seal to prevent the oil rising. The pressure rise caused by the temperature rise of the crank chamber is handled by the pressure-resistant oil seal, and the pressure fluctuations inside/outside the oil sealing bellows are absorbed by the pressure adjusting bellows in the buffer tank.

Figures 6A, 6B:
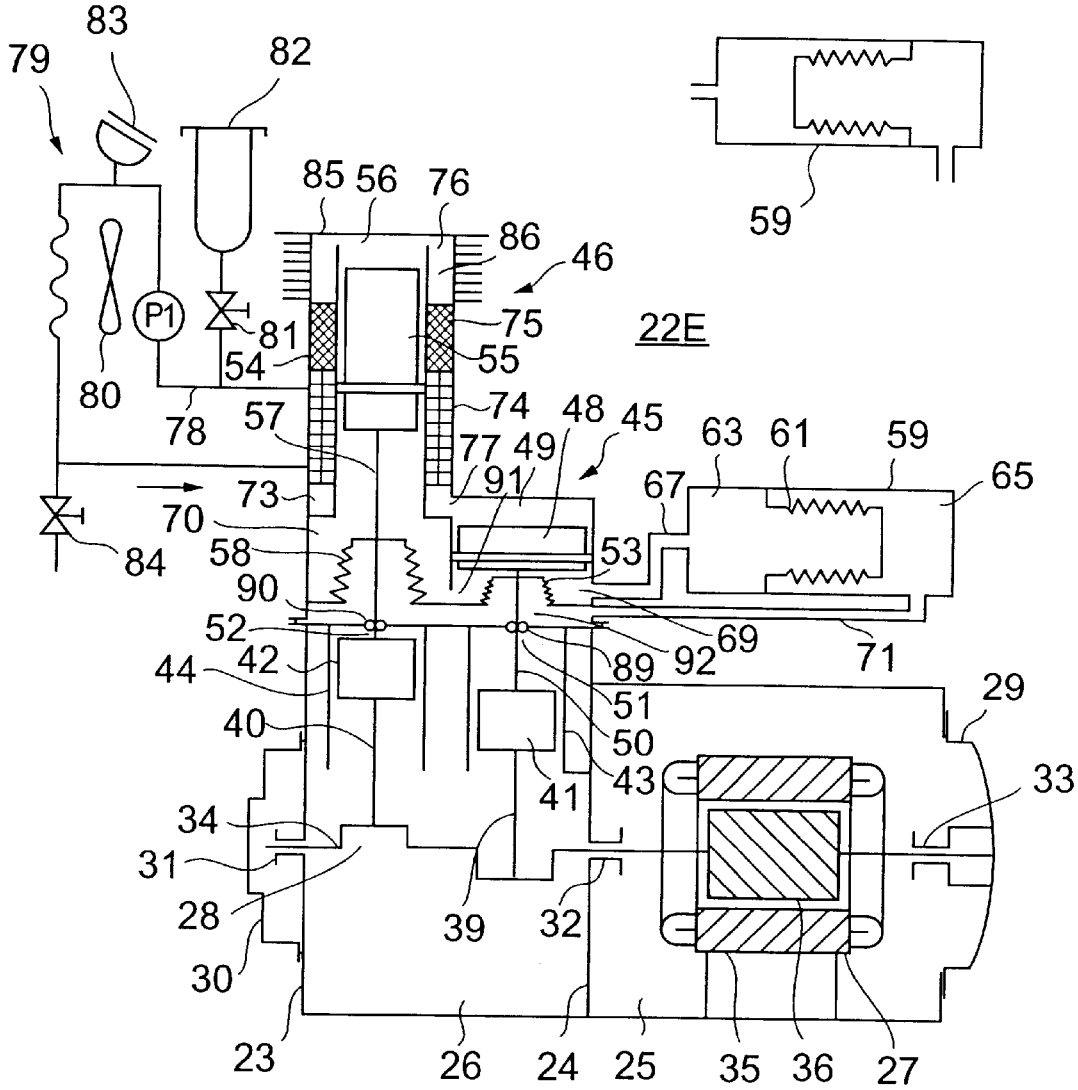
FIGS. 6*a* and 6*b* are diagrams showing a fifth embodiment of the Stirling cycle refrigerator according to the present invention.

In FIG. 6*a,* between the upper openings 51, 52 of the housing 23 and the compression piston rods 50, 57, there are provided oil seals (oil seal rings) 89, 90 which are manufactured of rubber, resin, an the like and are generally structured but are pressure resistant. Additionally, the spaces 69, 70 on the back surface side of the compression piston 48 and the expansion piston 55 are interconnected via an opening 91, and the oil sealing bellows 53, 58 are integrally formed to partition the spaces 69, 70 and form a seal chamber 92. The oil sealing bellows 53, 58 have bellows-shaped cylindrical portions whose top portions are fixed to the compression piston rod 50 and the expansion piston rod 57 and whose lower peripheral edges are fixed to the inner surfaces of the compression cylinder 45 and the expansion cylinder 46.

Additionally, there is the buffer tank 59 which has the same structure as that of the first embodiment, and inside which the pressure adjusting bellows 61 are formed. The chamber 63 on the opening side is connected to the spaces 69, 70 via the pipe 67, and the chamber 65 on the closing side is connected to the seal chamber 92 via the pipe 71. Furthermore, as shown in FIG. 6*b,* the buffer tank 59 may be directed horizontally in reverse.

The fifth embodiment constituted as described above is applied to the case where the pressure rise caused by the temperature rise of the space in the housing 23 is small, the pressure-resistant oil seals (oil seal rings) 89, 90 prevent the oil rising, and the influence onto the seal chamber 92 by the pressure rise caused by the temperature rise of the space of the housing 23 is prevented.

Furthermore, the pressure fluctuations are caused between the spaces 69, 70 on the back surface side and the seal chamber 92 by the reciprocation of the compression piston 48 and the expansion piston 55, but they are absorbed and canceled by the pressure adjusting bellows 61 of the buffer tank 59. Additionally, the sixth embodiment is different from the first embodiment in the sealing and pressure adjusting structures as described above, but the embodiments are the same in the other structures and actions.

[Sixth Embodiment]

Figure 7:
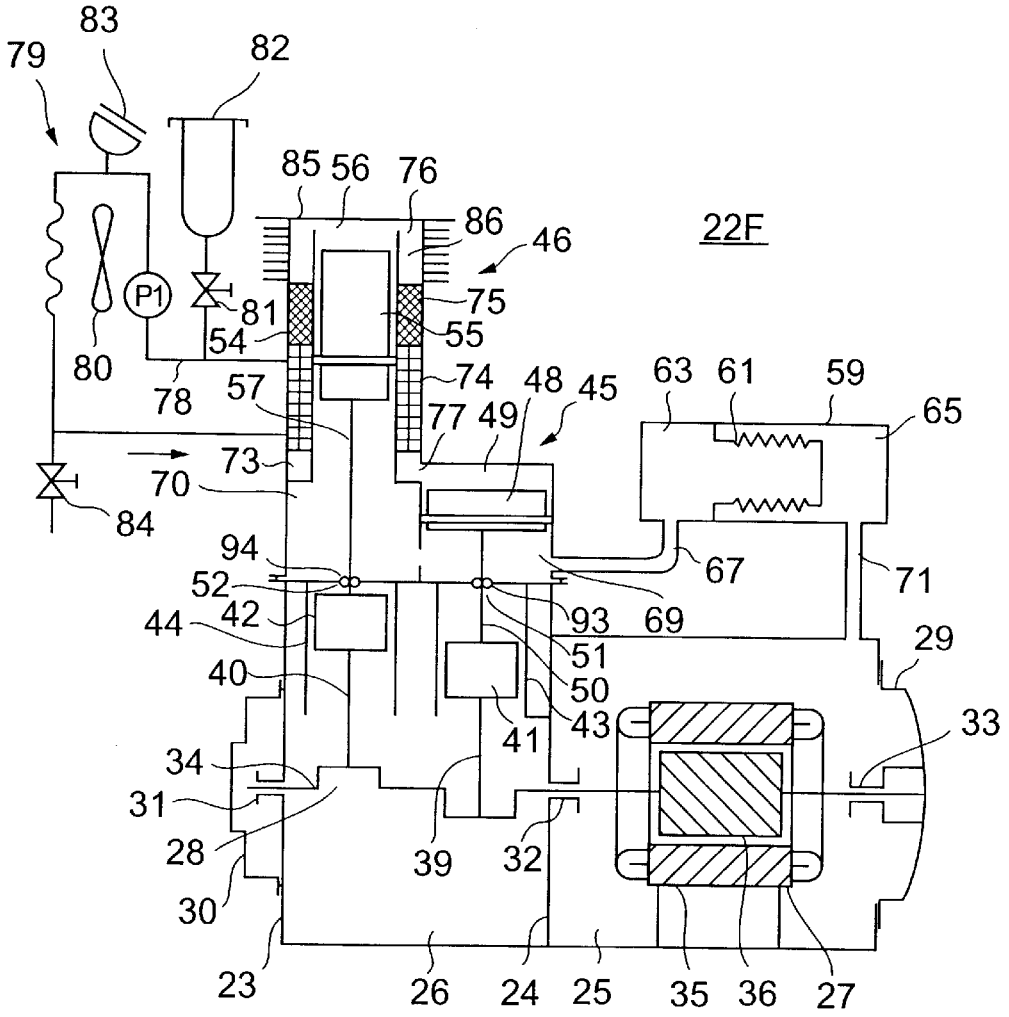
FIG. 7 is a diagram showing a sixth embodiment of the Stirling cycle refrigerator according to the present invention.

FIG. 7 is a diagram showing a sixth embodiment of the Stirling cycle refrigerator according to the-present invention. In outline, a Refrigerator 22F of the sixth embodiment is characterized in that the conventional Stirling cycle refrigerator provided with the general oil seal of rubber, or resin for preventing the oil rising is provided with the buffer tank which has pressure adjusting bellows for adjusting the pressure of the crank chamber.

The sixth embodiment is different from the first embodiment in the seal structure for preventing the oil rising, but is the same as the first embodiment in the other structures and actions. Specifically, in the sixth embodiment, without disposing the oil sealing bellows 53, 58, general oil seals 93, 94 manufactured with rubber, resin, and the like are disposed between the upper openings 51, 52 of the housing 23 and the compression and expansion piston rods 50, 57 so as to prevent the oil rising.

Furthermore, in the same manner as the first embodiment, the pressure rise accompanying the temperature rise of the space in the housing 23 and the pressure fluctuations of the spaces 69, 70 on the back surface side of the compression and expansion pistons during the operation of the Refrigerator are absorbed by the pressure adjusting bellows 61 in the buffer tank 59. In the constitution, the breakage of the oil seals 93, 94 which is easily caused during the pressure rise of the crank chamber 26 and the oil rising problem are prevented, and the durability and performance of the Refrigerator are enhanced.

[Seventh Embodiment]

Figure 8:
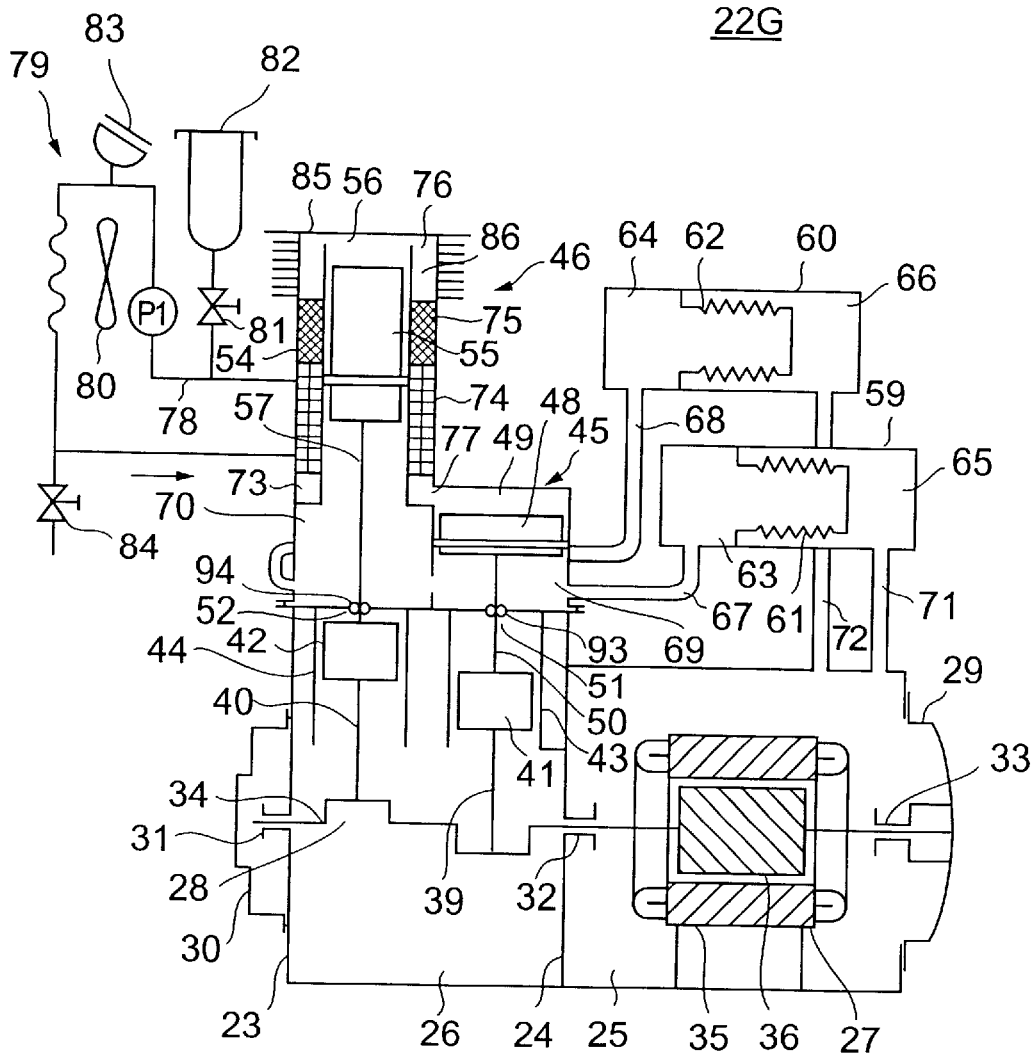
FIG. 8 is a diagram showing a seventh embodiment of the Stirling cycle refrigerator according to the present invention.

FIG. 8 is a diagram showing a seventh embodiment of the Stirling cycle refrigerator according to the present invention. In outline, in the same manner as in the sixth embodiment, a Refrigerator 22G of the seventh embodiment is characterized in that the general oil seal of rubber or resin is disposed to prevent the oil rising, and that the buffer tank provided with the pressure adjusting bellows is disposed to adjust the pressure of the crank chamber. However, different from the fifth embodiment, two buffer tanks 59, 60 are disposed in the same manner as the second embodiment.

Furthermore, the pressure rise accompanying the temperature rise of the space in the housing 23 and the pressure fluctuations of the spaces 69, 70 on the back surface side of the compression and expansion pistons during the operation of the Refrigerator are absorbed by the pressure adjusting bellows 61, 62 in the buffer tanks 59, 60. In the constitution, the breakage of the oil seals 93, 94 which is easily caused during the pressure rise of the crank chamber 26 and the oil rising problem are prevented, and the durability and performance of the Refrigerator are enhanced.

[Eighth Embodiment]

Figure 9:
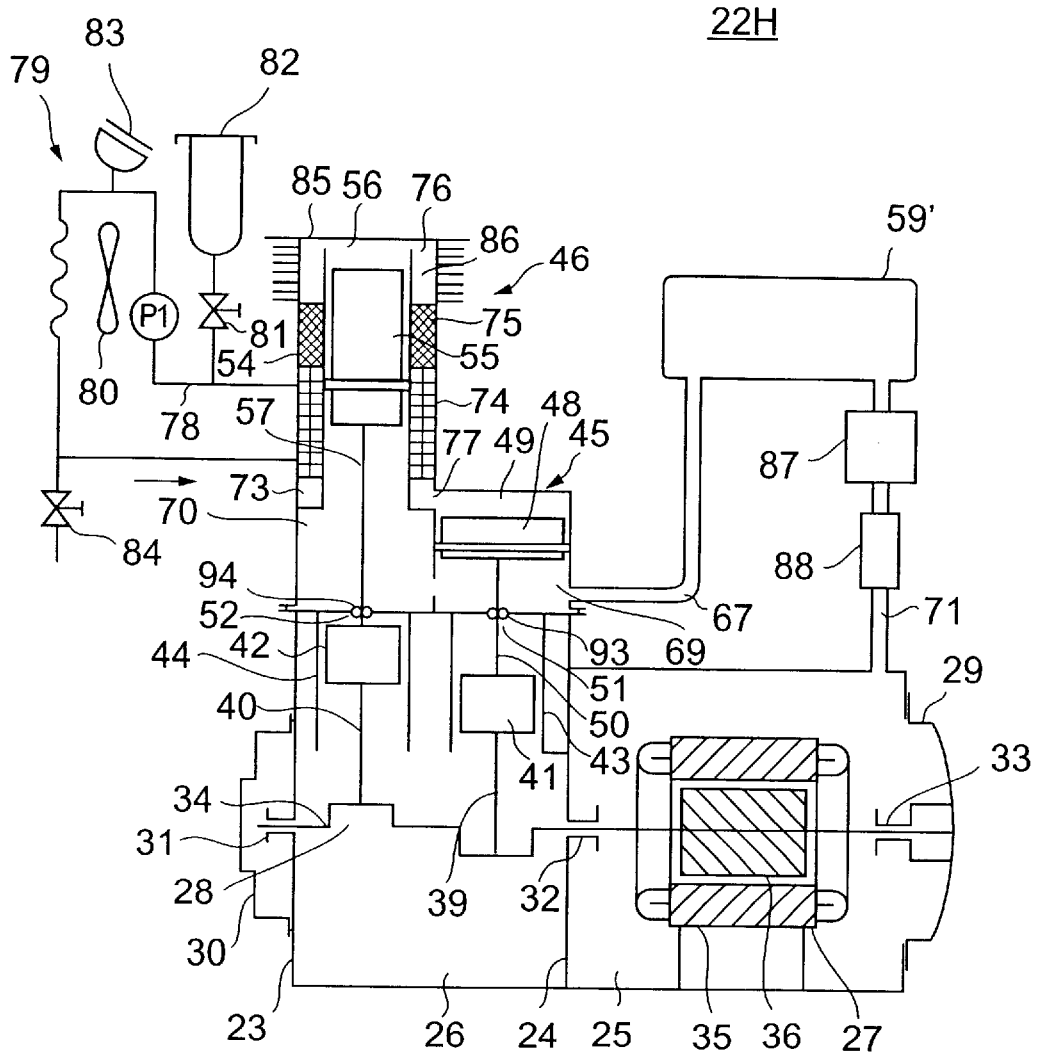
FIG. 9 is a diagram showing an eighth embodiment of the Stirling cycle refrigerator according to the present invention.

FIG. 9 is a diagram showing an eighth embodiment of the Stirling cycle refrigerator according to the present invention. For the outline of a Refrigerator 22H of the eighth embodiment, the general oil seal of rubber or resin is disposed to prevent the conventional oil rising, the buffer tank 59' provided with no bellows for absorbing the pressure fluctuations of the spaces 69, 70 on the back surface side of the compression piston 48 and expansion piston 55 (buffer tank provided with no pressure adjusting bellows) is disposed, and further the oil trapping device 87 is disposed to prevent the oil or oil mist of the crank chamber 26 from flowing into the spaces 69, 70 on the back surface side of the compression and expansion pistons.

Furthermore, as occasion demands the pressure adjustment constricting device 88 is connected in series with the oil trapping device 87. In the pressure adjustment constricting device 88, the capillary tube, the pressure adjusting valve, and the like are utilized in the same manner as in the fourth embodiment.

Additionally, in the same manner as the first embodiment, the temperature rise of the space in the housing 23 and the pressure fluctuations of the spaces 69, 70 on the back surface side of the compression and expansion pistons during the operation of the Refrigerator are absorbed by the pressure adjustment constricting device 88 and buffer tank 59. In the constitution, the breakage of the oil seal which is easily caused during the pressure rise of the crank chamber and the oil rising problem are prevented, and the durability and performance of the Refrigerator are enhanced.

[Ninth Embodiment]

Figure 10:
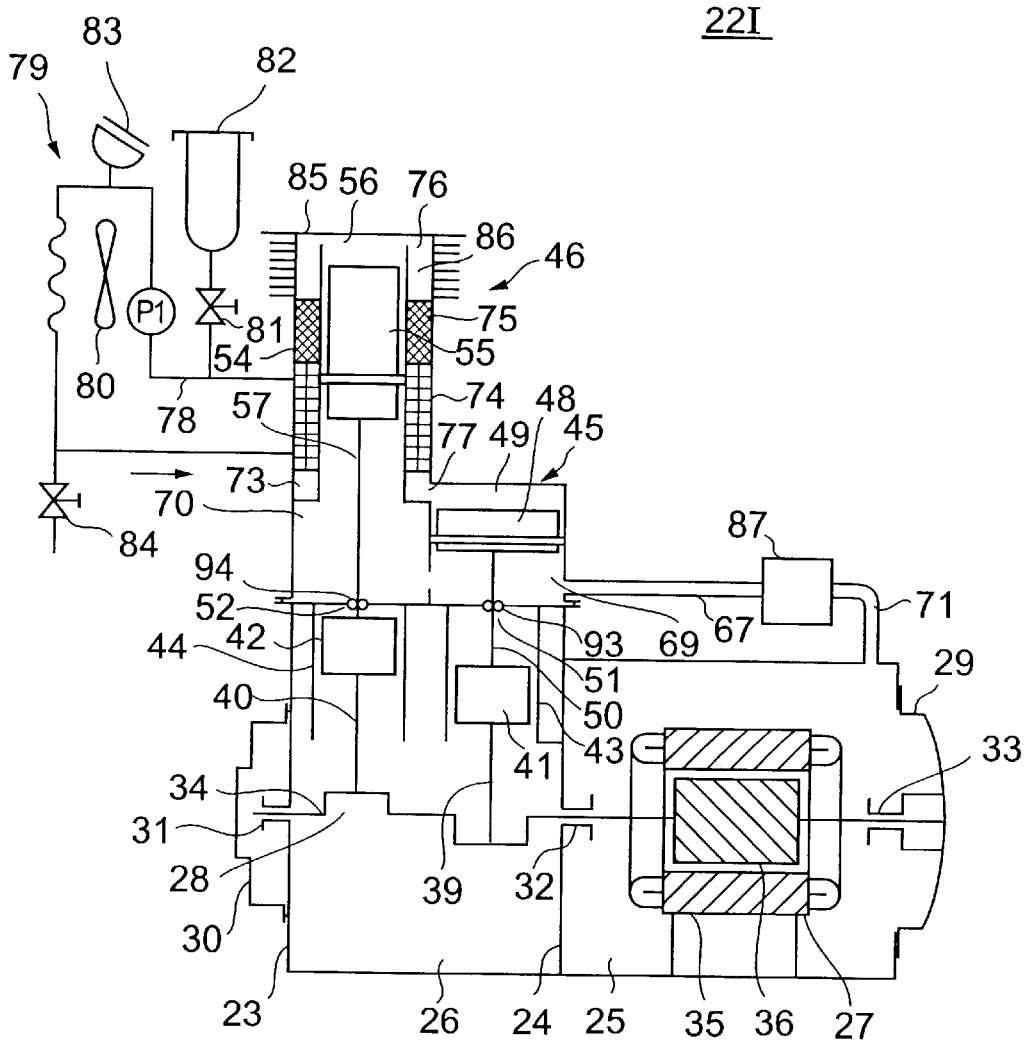
FIG. 10 is a diagram showing a ninth embodiment of the Stirling cycle refrigerator according to the present invention.

FIG. 10 is a diagram showing a ninth embodiment of the Stirling cycle refrigerator according to the present invention. In a Refrigerator 221 of the ninth embodiment, the general oil seals 93, 94 manufactured with rubber, resin, and the like are disposed between the upper openings 51, 52 of the housing 23 and the compression piston rods 50, 57 to prevent the oil rising, and the spaces 69, 70 on the back surface side of the compression and expansion pistons are connected to the space in the housing 23 via the pipe 67, oil trapping device 87 and pipe 71, so that the pressure fluctuations generated in the spaces 69, 70 are prevented.

Figure 11:
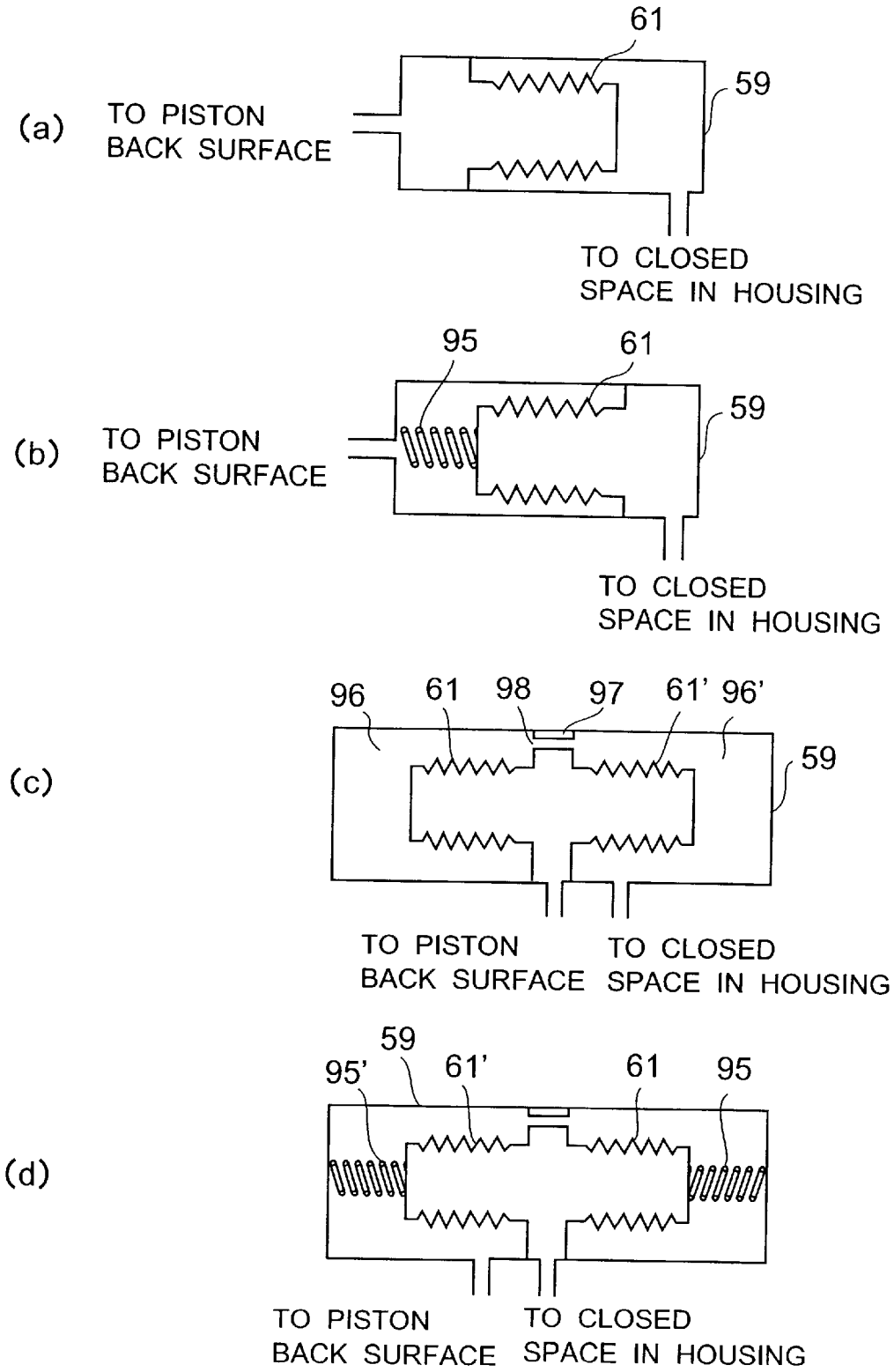
FIGS. 11*a*–11*d* are diagrams showing concrete examples of pressure adjusting bellows of a buffer tank of the Stirling cycle refrigerator according to the present invention.
Figure 12:
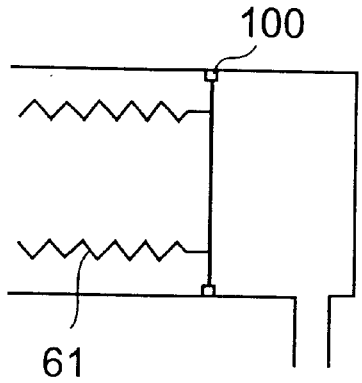
FIGS. 12*a*–12*c* diagrams showing concrete examples of a guide of the pressure adjusting bellows of the Stirling cycle refrigerator according to, the present invention.
Figure 12:
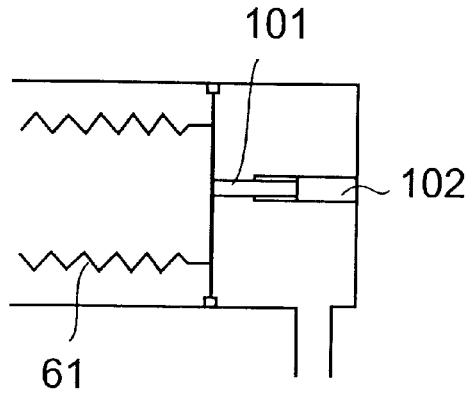
Figure 12:
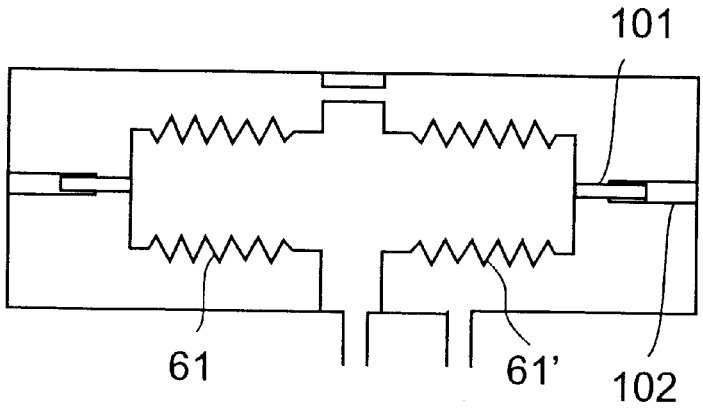

The structure of the buffer tank provided with the bellows for use in the embodiment will next be described. FIG. 11 is a diagram showing some concrete examples of the buffer tank and pressure adjusting bellows. FIG. 11*a* shows a basic structure comprising one set of bellows, which are the same as those already used in the above-described embodiments. With respect to a static fluctuation with which the pressure of the crank chamber rises during the operation of the refrigerator, the pressure adjusting bellows 61 move slowly, but displacement amount is enlarged. Moreover, for a dynamic pressure fluctuation on the back surface side accompanying the reciprocation of the expansion piston, and the like, the displacement amount is small, and vibrating operation is performed.

FIG. 11*b* shows a constitution in which an initially set compression force is applied to the pressure adjusting bellows 61 by a compression coil spring 95. In the constitution, the displacement amount of the pressure adjusting bellows corresponds to the pressure fluctuation on the back surface side of (pressure rise of crank chamber initially set compression)+pressure fluctuation on the back surface side of the expansion piston, and the like. Therefore, since the displacement by the pressure rise of the crank chamber is applied in the initial stage, the bellows approach the free length so as to solve the displacement amount during the operation, so that the long life of the bellows can be attained.

FIG. 11*c* shows a structure of opposite type pressure adjusting bellows in which a pair of left and right pressure adjusting bellows 61, 61' are integrally disposed in the buffer tank. Left and right spaces 96, 96' outside the pressure adjusting bellows 61, 61' are interconnected via a connecting hole 98 for connecting a middle support portion 97. An inner space 99 of the pressure adjusting bellows 61, 61' is connected to the back surface side of the compression piston, and the like, and the left and right spaces 96, 96' outside the pressure adjusting bellows are connected to the side of the crank chamber. For the buffer tank, since the left and right pressure adjusting bellows 61, 61' are disposed, the pressure adjusting bellows can relatively be shortened, so that deflection in a direction (transverse direction) perpendicular to expansion/contraction direction can be eliminated.

(3) The problem of pressure fluctuation generated on the back surface side of the compression or expansion piston which adversely affects the performance of the oil seal or the refrigerator is solved by employing the buffer tank provided with or without the pressure adjusting bellows.

(4) By solving the above-described problems peculiar to the Stirling cycle refrigerator, as the refrigerants other than Freon, low-melting refrigerants such as ethyl alcohol, nitrogen and helium can be used in the operating gas, the temperature for use falls in a broader range than that of the conventional cooling device, and the present invention can be applied to the cooling heat utilizing apparatus for extensive purposes. Additionally, there can be provided with a device adaptable to the earth environmental problem and having a large refrigerating capability, in which heating/cooling operation can be performed by rotating the motor forward or in reverse.

Figure 13:
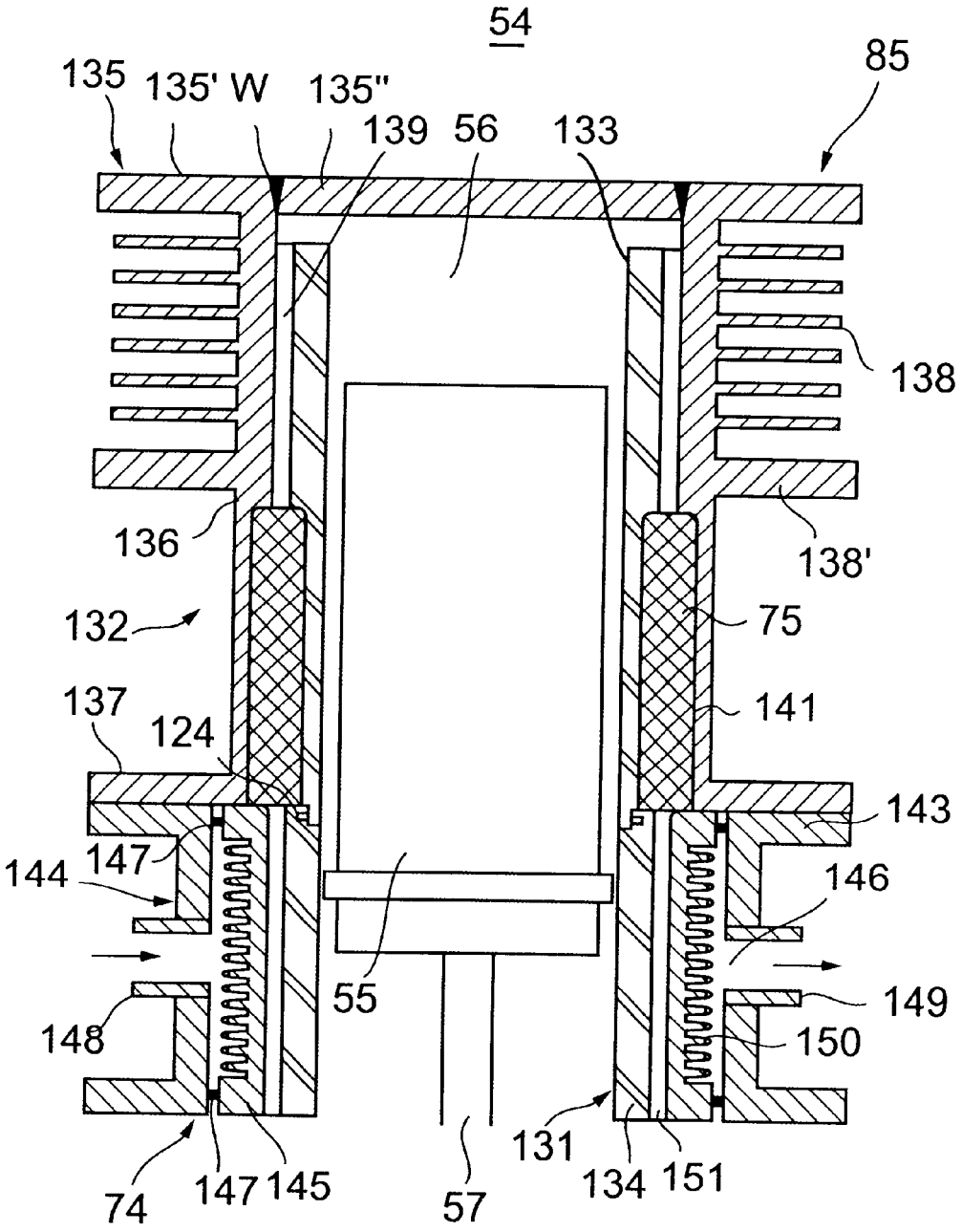
FIG. 13 is a sectional view showing an expansion cylinder block of the Stirling cycle refrigerator according to the present invention.

As one example of the cylinder block for use in the refrigerator of the above-described embodiment, the cylinder block 54 will next be described in detail with reference to FIGS. 13 to 16. In FIG. 13, the cylinder block 54 is constituted of an inner cylinder 131, the radiating heat exchanger 74 concentrically disposed outside the lower part of the inner cylinder 131, and a low-temperature side heat exchange housing (top heat exchange housing) 132, disposed on the exchanger. The inner cylinder 131 forms a cylinder space in which the expansion piston 55 reciprocates, and upper and lower portions 133, 134 are assembled via an O ring 124, or may integrally be manufactured.

Figure 14:
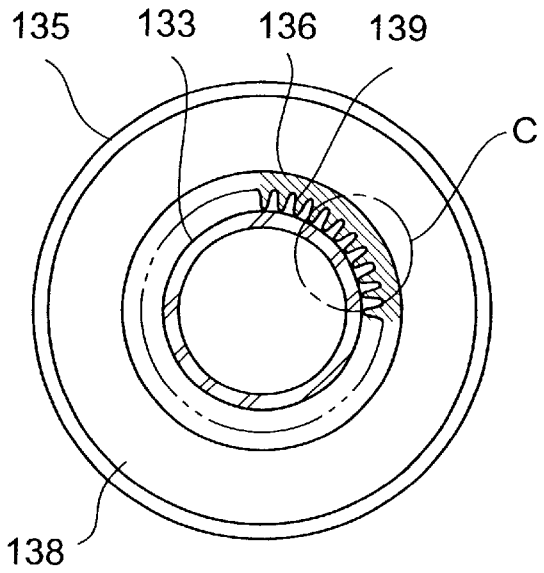
FIGS. 14*a*–14*c* show a sectional view, a plan view and an enlarged view of a low-temperature side heat exchange housing (top heat exchange housing) of the expansion cylinder block of FIG. 13.
Figure 14:
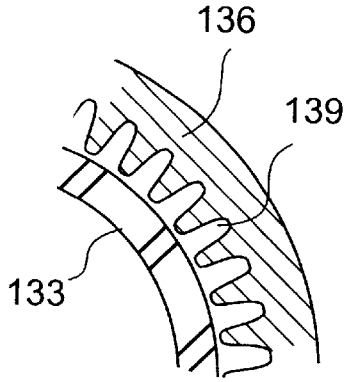
Figure 14:
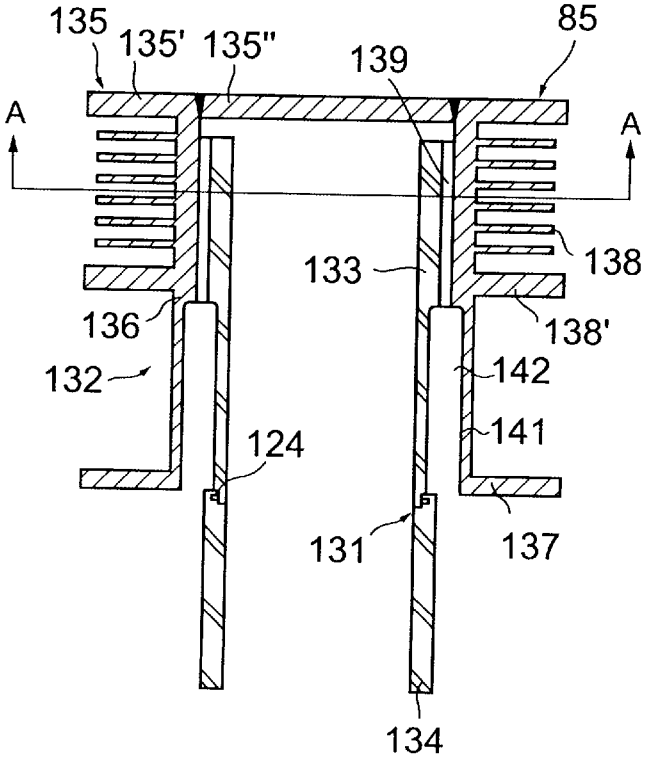

FIG. 14*a* shows the low-temperature side heat exchange housing 132, FIG. 14*b* is a plan view taken along A—A of FIG. 14*a*, and FIG. 14*c* is an enlarged view of a main part. In FIGS. 13 and 14, the low-temperature side heat exchange housing 132 has a cylindrical shape, and is constituted of a top wall 135, a side wall 136 and a lower end flange portion 137. The top wall 135 is constituted of a flange top wall portion 135' and a middle top wall portion 135", and the middle top wall portion 135*w* is integrally welded to the top end inner surface of the side wall 136. Moreover, the top wall 135 may integrally be formed with the side wall 136 by lost wax casting described later.

On the top end inner peripheral surface of the side wall 136, the outer surface of the inner cylinder 131 closely abuts, and a multiplicity of longitudinal fine grooves 139 are formed at intervals in a circumferential direction. The fine grooves 139 and the outer surface of the inner cylinder 131 form the channel of operating gas. In this manner, the top (the above-described cold head 85) of the low-temperature side heat exchange housing 132 forms the cooling heat exchanger (low-temperature side heat exchanger) 76. The cold head 85 contacts the cooling heat refrigerant such as air, water and alcohol to cool the cooling heat refrigerant.

The low-temperature side heat exchange housing 132 has annular recesses 141 formed in the inner peripheral surface of its middle, and forms an annular space 142 with the inner cylinder 131, and the inside of the housing is filled with metal meshes and other regenerator materials to form the regenerator 75. The lower end flange portion 137 of the low-temperature side heat exchange housing 132 is laid on an upper end flange portion 143 of the radiating heat exchanger 74.

The low-temperature side heat exchange housing 132 of the present invention is cast by a lost wax method by SUS and other materials. Specifically, the low-temperature side heat exchange housing 132 is characterized by a constitution in which the housing is integrally manufactured by the lost wax casting so that a cooling fin 138 is formed on the outer peripheral surface and the operating gas channel fine grooves 139 are formed in the inner peripheral surface.

The low-temperature side heat exchange housing 132 manufactured by the lost wax casting as described above is extremely superior in radiating performance because the cooling fin 138 is formed precisely in fine rib shapes in the outer surface. Moreover, since the axial fine grooves 139 formed in the inner surface are also precisely cast, the operating gas can flow uniformly without being partially obstructed, thereby enhancing the refrigerating performance.

Figure 15:
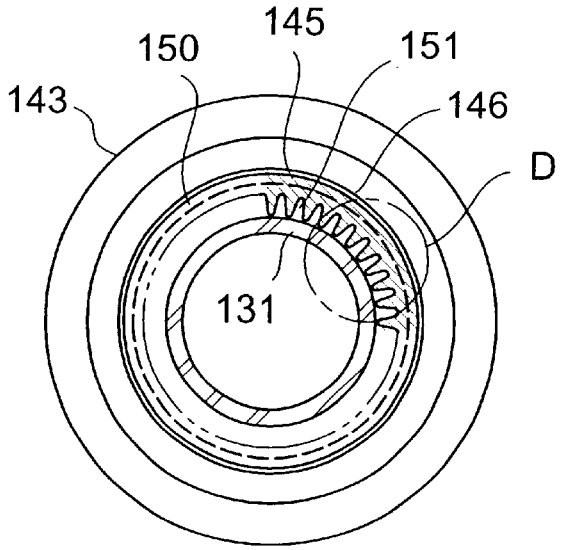
FIGS. 15*a*–15*c* show a sectional view, a plan view and an enlarged view of a high-temperature side heat exchange housing (annular heat exchange housing) of the expansion cylinder block of FIG. 13.
Figure 15:
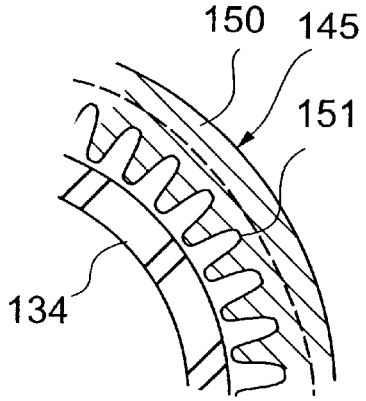
Figure 15:
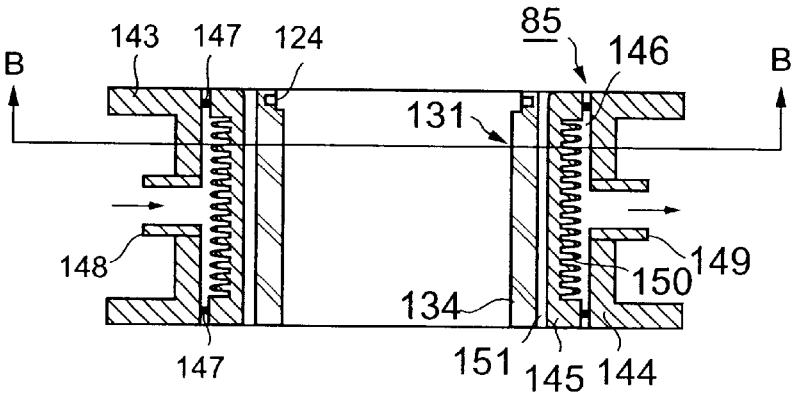

FIG. 15*b* is a plan view taken along B—B of FIG. 15*a,* and FIG. 15*c* is an enlarged view of a main part. In FIGS. 13 and 15, the radiating heat exchanger 74 Is an annular type heat exchanger, and has a high-temperature side heat exchange housing (annular heat exchange housing) 144 and a heat exchanger body 145 concentrically inserted into the housing. A heat exchange medium channel 146 is formed between the high-temperature side heat exchange housing 144 and the heat exchanger body 145, and upper and lower ends are sealed by seals 147. A flow inlet 148 and a flow outlet 149 are formed and connected to the channel 146.

A multiplicity of radiating fins 150 are formed opposite to the channel 146 on the outer peripheral wall of the heat exchanger body 145, and a multiplicity of fine grooves 151 are formed at constant intervals in the circumferential direction on the inner peripheral wall surface of the heat exchanger body 145 to form a heat exchange fluid channel of helium, and the like with the inner cylinder 131.

In FIG. 2, as described above the radiating heat exchanger 74 is connected to the radiator 79 via the cooling water circulating pipe line 78 and the cooling water pump P1 to circulate the cooling water. The cooling water subjected to heat exchange and heated in the radiating heat exchanger 74 is cooled by the cooling fan 80 of the radiator 79. The cooling water circulating pipe line 78 is connected to the water reservoir tank 82 via the reservoir valve 81. Moreover, the radiator 79 is connected to the air vent 83 and additionally to the drain valve 84.

The heat exchanger body 145 of the radiating heat exchanger 74 of the present invention is cast by SUS, copper, aluminum, and other materials by the lost wax method, and the radiating fins 150 formed on the outer surface of the heat exchanger body 145 are cast precisely in fine rib shapes, so that extremely superior radiating performance is provided. Moreover, since the axial fine grooves 151 formed in the inner surface are precisely and integrally cast, the operating gas can uniformly flow without being partially obstructed, thereby enhancing the refrigerating performance. The high-temperature side heat exchange housing 144 may be formed by lost wax casting as described above, or may be manufactured by usual iron casting.

Figure 16:
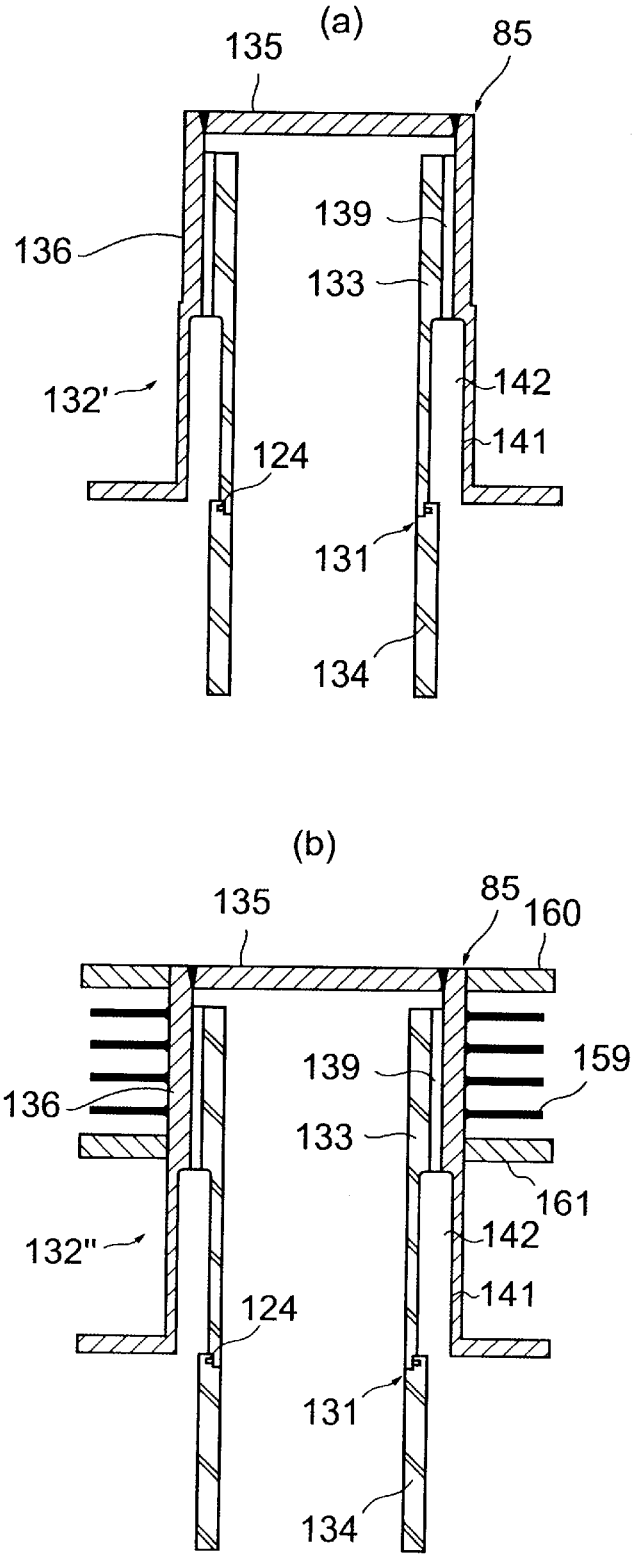
FIGS. 16*a* and 16*b* show sectional views of first and second modifications of the low-temperature side heat exchange housing of the expansion cylinder block of the Stirling cycle device according to the present invention.

FIG. 16 is an explanatory view showing modification examples of the low-temperature side heat exchange housing of the expansion cylinder block 54 according to the present invention. FIG. 16*a* shows a low-temperature side heat exchange housing 132' as a first modification example, and the low-temperature side heat exchange housing 132' has no fins or flanges formed integrally on the outer peripheral surface by lost wax casting. In the first modification example, the housing is used in the state in which no fins or the like are provided (state of FIG. 16*a*), and heat exchange is performed with air and other refrigerants contacting the peripheral surface. Alternatively, the outer peripheral surface is wound with a heat exchanging tube (not shown) for passing the refrigerants, and the like to be subjected to the heat exchange for use, or external fins and flanges are attached later to the peripheral surface for use.

FIG. 16*b* shows a second modification example in which the external fins and flanges are formed by the later attachment. In a low-temperature side heat exchange housing 132" as the second modification example, on the peripheral surface, external fins 159 manufactured in annular shapes with materials such as Cu, Al and SUS, and flanges 160, 161 of the same materials as those of the housing are attached by welding or the like. The external fins may have spiral shapes and other shapes.

In the constitution, while the expansion piston 55 slowly moves ahead by about 90 degrees in the vicinity of the upper dead point, the compression piston 48 rapidly moves toward the upper dead point in the vicinity of the middle to perform the compressing operation of the operating gas. The compressed operating gas flows into the fine grooves 151 of the radiating heat exchanger 74 through the connecting hole 77 and the manifold 73. The operating gas whose heat is radiated to cooling water in the radiating heat exchanger 74 is cooled in the regenerator 75, and flows into the low temperature chamber (expansion space) 56 through the grooves of the cooling heat exchanger 76.

When the compression piston 48 slowly moves in the vicinity of the upper dead point, the expansion piston 55 rapidly moves toward the lower dead point, and the operating gas flowing into the low-temperature chamber (expansion space) 56 is rapidly expanded, thereby generating cooling heat. Thereby, the cold head 85 is cooled to reach a low temperature.

Subsequently, in the cold head 85, the cooling heat refrigerant contacting the cooling fins 138 is cooled. When the expansion piston 55 moves to the upper dead point from the lower dead point, the compression piston 48 moves toward the lower dead point from the middle position, the operating gas flows into the regenerator 75 from the low-temperature chamber 56 through the fine grooves 139 of the cold head 85, and the cooling heat of the operating gas Is accumulated in the regenerator 75.

The above-described constitution can provide the following effects.

(5) In the top heat exchange housing constituting the expansion cylinder block, by integrally forming the operating gas channel in the inner surface, or by integrally forming the fins for cooling the cooling heat refrigerant on the outer surface in addition to the operating gas channel in the inner surface, and particularly by performing the lost wax casting for precise formation, processability is improved, and the refrigerator itself is extremely simplified in structure and reduced in cost. Additionally, the operating gas in the grooves uniformly flows without being partially obstructed, and the heat exchange performance and reliability are enhanced with the precisely formed fins having a uniform thickness.

(6) Since the annular heat exchange housing and heat exchanger body of the radiating heat exchanger are integrally formed, particularly by precisely forming the components by lost wax casting, the processability is improved, and low price is realized. The operating gas in the grooves uniformly flows without being partially obstructed, thereby enhancing the heat exchange performance and reliability.

(7) Since the refrigerants other than Freon, such as ethyl alcohol, nitrogen, helium, and other low-melting refrigerants, are used as the operating gas, there can be provided a Freon substitute refrigerator superior in environmental property.

Additionally, the cylinder block is effective in a Stirling cycle apparatus, Wirmle cycle apparatus, Kuk Yaborof cycle apparatus, and other Stirling cycle devices.

Figure 17:
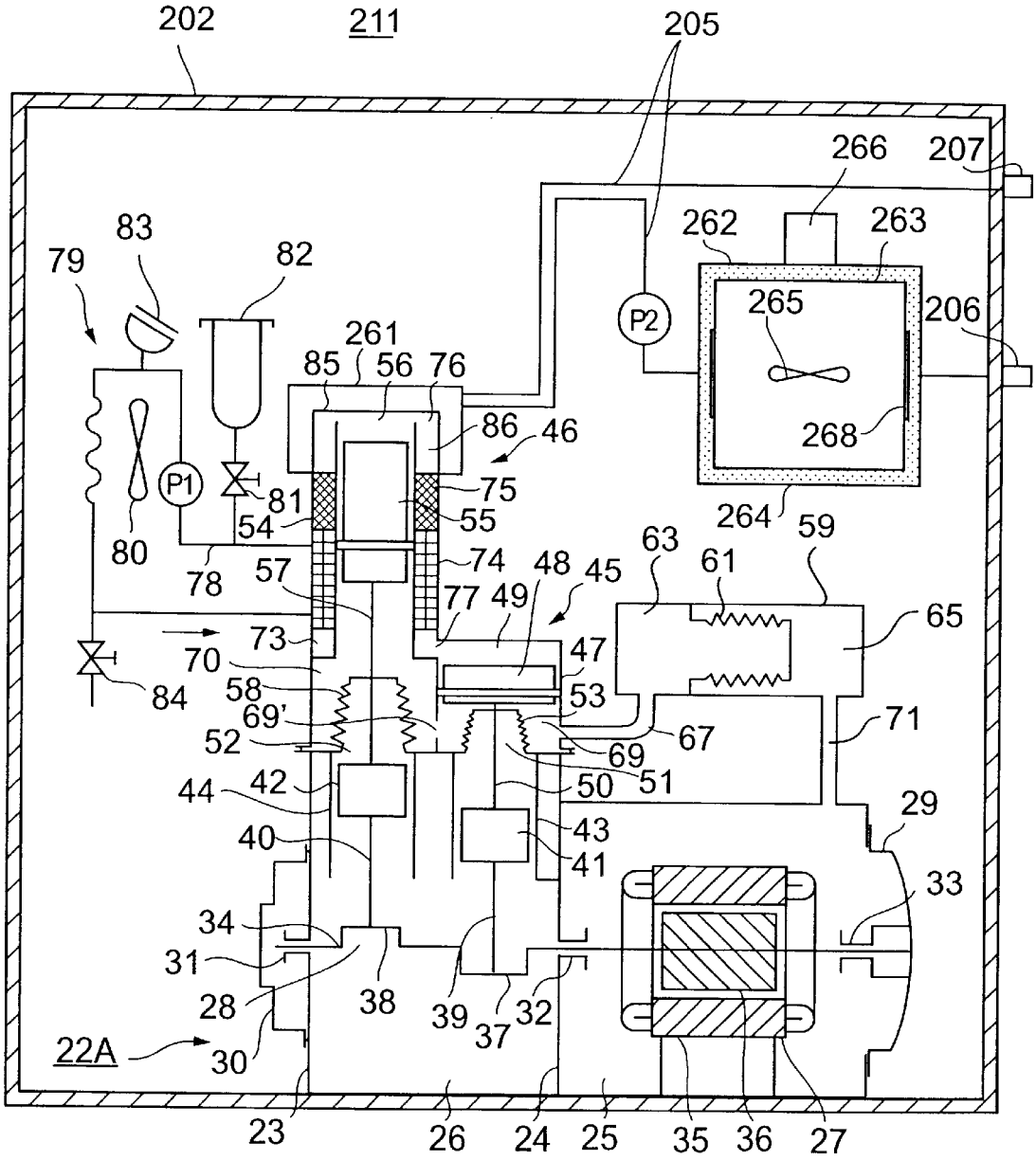
FIG. 17 is a diagram showing one embodiment of an isothermal fluid circulating device constituted using the Stirling cycle refrigerator of the present invention.
Figure 18:
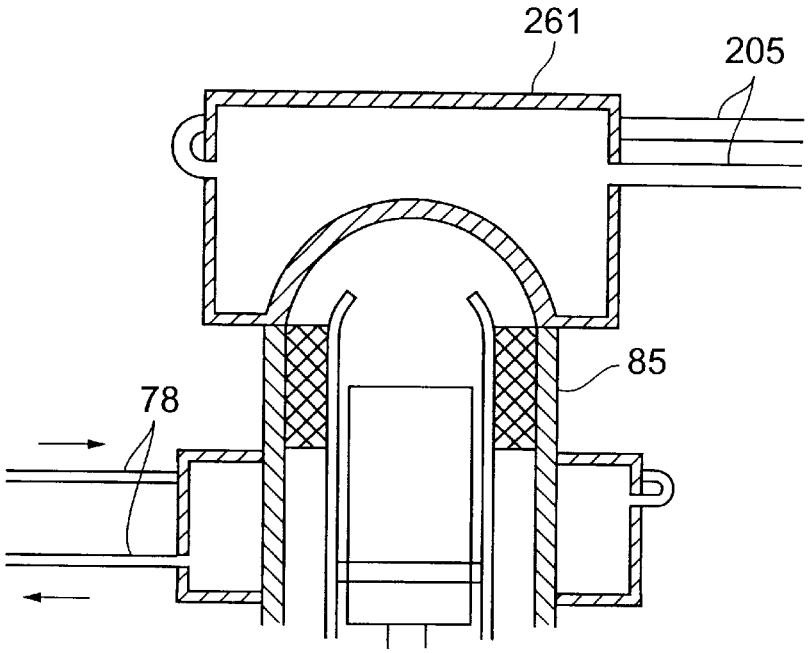
FIG. 18 is an explanatory view of one example of a cooling heat exchanger and a radiating heat exchanger of the isothermal fluid circulating device using the Stirling cycle refrigerator of FIG. 17.

Next, FIG. 17 shows an isothermal fluid circulating device 211 as the Stirling cycle device which is constituted using the above-described Refrigerator 22A of the first embodiment. Additionally, in the drawing, the components shown with the same reference numerals are the same. In this case, no cooling fins are formed outside the cooling heat exchanger 76, and instead, to cool the cooling heat refrigerant in the cold head 85, for example, as shown in FIG. 18, a jacket 261 is disposed around the cold head 85, so that the cooling heat refrigerant flows in the-jacket 261. Additionally, numeral 202 denotes a box-shaped case, and the Refrigerator 22A and a cooling heat refrigerant isothermal fluid storage tank 262 described later are disposed in the case 202.

Figure 19:
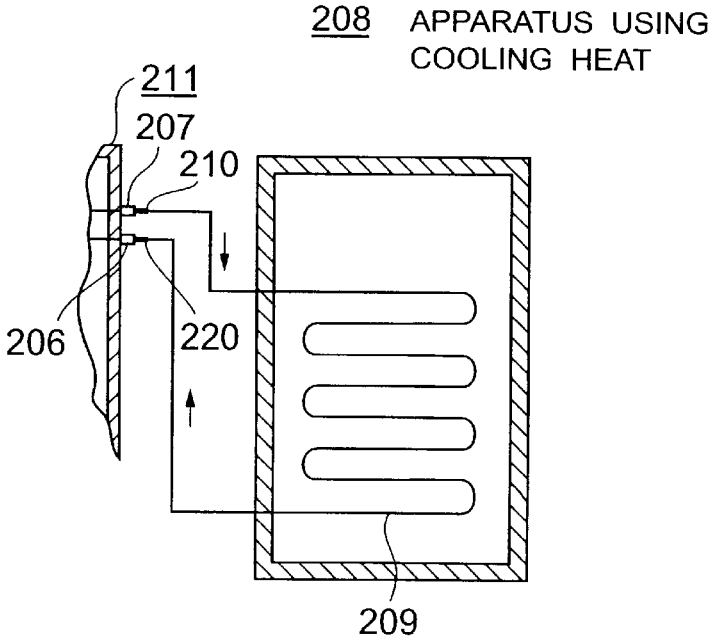
FIG. 19 is a diagram showing a cooling heat utilizing apparatus connected to the isothermal fluid circulating device using the Stirling cycle refrigerator of FIG. 17.

The cold head 85 is connected to a cooling heat utilizing apparatus 208 schematically shown in FIG. 19 via a cooling heat refrigerant pipe line 205 and a cooling heat refrigerant pump P2 to circulate the cooling heat refrigerant. Additionally, a cooling heat refrigerant inlet stopper 206 is disposed outside the case 202, and connected to the cooling heat refrigerant isothermal fluid storage tank 262. Moreover, an outlet stopper 207 is disposed outside the case 202, and connected to the cooling heat refrigerant pipe line 205.

Then, the inlet stopper 206 and the outlet stopper 207 are disconnectably connected to an outlet end 220 and an inlet end 210 of the cooling heat refrigerant piping 209 of the cooling heat utilizing apparatus 208 such as the freezer. Additionally, examples of the cooling heat utilizing apparatus 208 include, in addition to the freezer, a refrigerator, a throw-in cooler, an isothermal fluid circulating device, a low-temperature isothermal unit for various thermal property tests, an isothermal tank, a heat shock test device, a freezing drier, a cold cooler, and the like. The isothermal fluid circulating device 211 can be utilized by connecting the cooling heat utilizing apparatus 208 to the inlet stopper 206 and the outlet stopper 207.

The cooling heat refrigerant Isothermal fluid storage tank 262 is disposed midway in the cooling heat refrigerant pipe line 205. The cooling heat refrigerant isothermal fluid storage tank 262 is constituted by covering a fluid storage tank wall 263 with an insulating wall 264, and may be a closed type or an open type having a lid.

The capacity of the cooling heat refrigerant isothermal fluid storage tank 262 is appropriately designed In accordance with the freezing ability of the freezer, purposes, and the like, and for example, the capacity of about 10 to 20 liters is used. In the cooling heat refrigerant isothermal fluid storage tank 262, an agitating blade 265 for agitating the cooling heat refrigerant is disposed so that it can be rotated by a motor 266. Therefore, the fluid temperature of the cooling heat refrigerant in the cooling heat refrigerant isothermal fluid storage tank 262 is uniformed.

The cooling heat refrigerant isothermal fluid storage tank 262 has a function of storing the cooling heat refrigerant and reducing the temperature fluctuation of the cooling heat refrigerant. As the cooling heat refrigerant, ethyl alcohol, HFE, PFC, PFG, nitrogen, helium, and the like are used, and for the temperature of the cooling heat refrigerant, an ultra-low temperature of −150° C. can be attained.

The isothermal fluid circulating device 211 utilizing the Stirling cycle refrigerator of the present invention is provided with a temperature adjustment device. The temperature adjustment device 267 performs temperature adjustment using both or either one of the operation control of the Refrigerator 22A and the heating by an electric heater 268 attached to the outer surface of the fluid storage tank wall 262.

Figure 20:
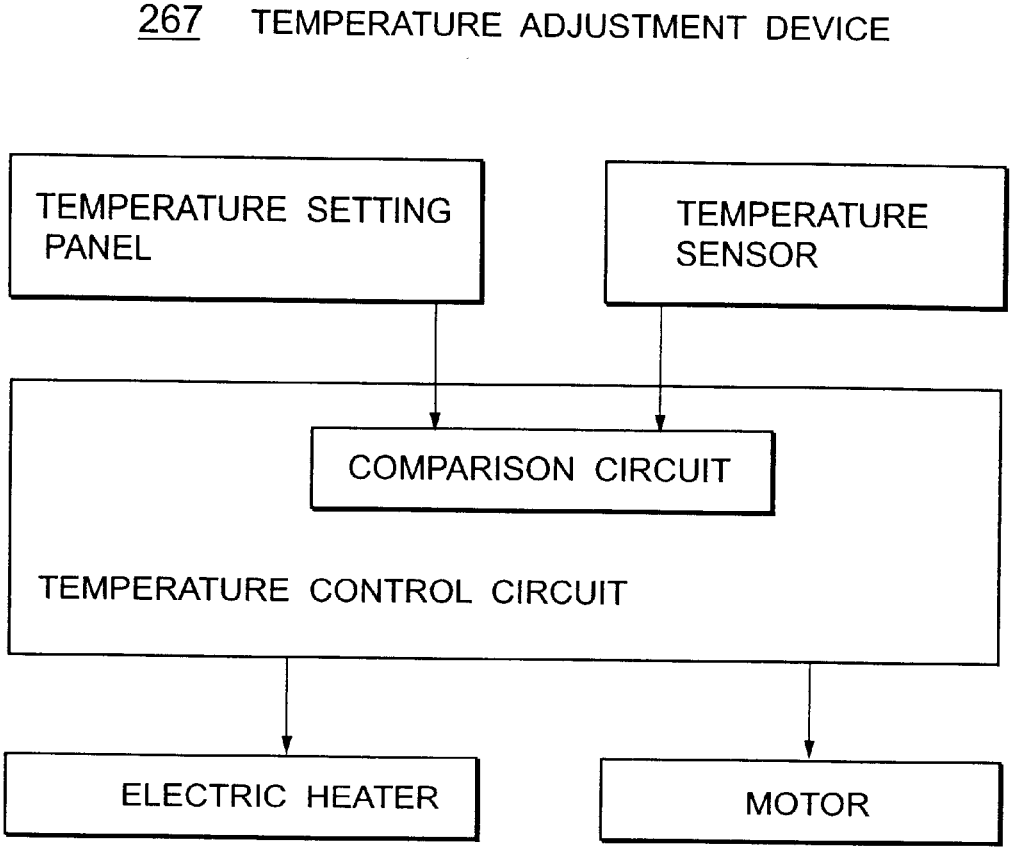
FIG. 20 is an explanatory view of a temperature adjustment device of the isothermal fluid circulating device using the Stirling cycle refrigerator of FIG. 17.

In FIG. 20, the cooling heat refrigerant isothermal fluid storage tank 262 is provided with a cooling heat refrigerant temperature sensor, a temperature setting panel for performing temperature setting and a temperature control device. In a comparison circuit in a temperature control circuit (not shown) constituting the temperature control device, a temperature signal detected by the cooling heat refrigerant temperature sensor and a value set in the temperature setting panel are compared. It is judged whether or not the temperature is in an allowable temperature range centering on the set temperature, and according to a result, the motor 27 of the Refrigerator 22A is PID controlled to adjust the cooling temperature. Alternatively, by performing ON/OFF control of the electric heater 268, or inverter pulse control to adjust the heating temperature, the temperature of the cooling heat refrigerant can be adjusted. In some cases, by rotating the motor 27 in reverse to place the cold head 85 In a high-temperature state, temperature adjustment operation can be performed.

The action of the isothermal fluid circulating device 211 utilizing the Refrigerator of the first embodiment of the present invention will next be described. The cooling heat refrigerant cooled in the cold head 85 is fed to the cooling heat refrigerant piping 209 in the cooling heat utilizing apparatus 208 such as the freezer from the cooling heat refrigerant pipe line 205 and the cooling heat refrigerant outlet stopper 207 to perform a freezing or cooling action in the cooling heat utilizing apparatus 208. In the cooling heat utilizing apparatus 208, the cooling heat refrigerant absorbs heat to perform the cooling action, is fed to the cooling heat refrigerant inlet stopper 206 from the cooling heat refrigerant piping 209, and is returned into the cooling heat refrigerant isothermal fluid storage tank 262 through the cooling heat refrigerant pipe line 205 to store the fluid.

Subsequently, the cooling heat refrigerant in the cooling heat refrigerant isothermal fluid storage tank 262 is returned to the cold head 85 of the Refrigerator 22A via the pump P2. In the present invention, the cooling heat refrigerant isothermal fluid storage tank 262 is disposed midway in the cooling heat refrigerant pipe line 205, and the cooling heat refrigerant isothermal fluid storage tank 262 functions as a buffer to suppress the temperature fluctuation.

Subsequently, in the comparison circuit in the temperature control circuit constituting the temperature control circuit 267, the temperature signal detected by the temperature sensor disposed in the cooling heat refrigerant isothermal fluid storage tank 262 and the temperature set in the temperature setting panel are compared, it is judged whether or not the temperature is in the allowable temperature range centering on the set temperature, and according to a result, the motor 27 of the Refrigerator 22A is PID controlled to adjust the cooling heat refrigerant temperature. Subsequently, according to the result of the comparison circuit, by performing the ON/OFF control of the electric heater 268, or the inverter pulse control to adjust the cooling temperature, or by adjusting the heating temperature of the electric heater, the temperature of the cooling heat refrigerant can be adjusted.

Both of the operation control of the motor 27 of the refrigerator 22A and the electric heater 268 can be used, but either one thereof may be used to perform the temperature control of the cooling heat refrigerant. When the operation control of the motor 27 and the heating of the electric heater 268 are both used, a more precise temperature control can be performed.

Moreover, in the present invention, the heating operation by the reverse rotation of the motor 27 can be utilized. Specifically, when the motor 27 of the refrigerator 22A rotates in reverse, the compression piston 48 and the expansion piston 55 have a phase difference of about 90 degrees, and in completely reverse to the case where the motor 27 rotates forward, the compression piston 48 acts as the expansion piston, and the expansion piston 55 acts as the compression piston.

Thereby, the operating gas in the expansion space of the expansion cylinder is compressed by the expansion piston 55 to generate heat, and the cooling heat refrigerant is heated by the cold head 85. Specifically, while the usual cooling operation is performed, the temperature of the isothermal tank 262 is measured. According to the result, by the temperature control circuit of the temperature control device, the motor 27 is successively rotated in reverse and controlled to perform the heating operation, so that constant temperature can be maintained.

When the frost generated in the cold head 85, the heating/cooling heat exchanger of the cooling heat utilizing apparatus 208, and the like is removed, the frost is detected by a frost sensor. By a defrosting control circuit, the motor is rotated in reverse as described above to heat the cold head 85. Alternatively, by heating/circulating the cooling heat refrigerant, defrosting can effectively be performed.

Figure 21:
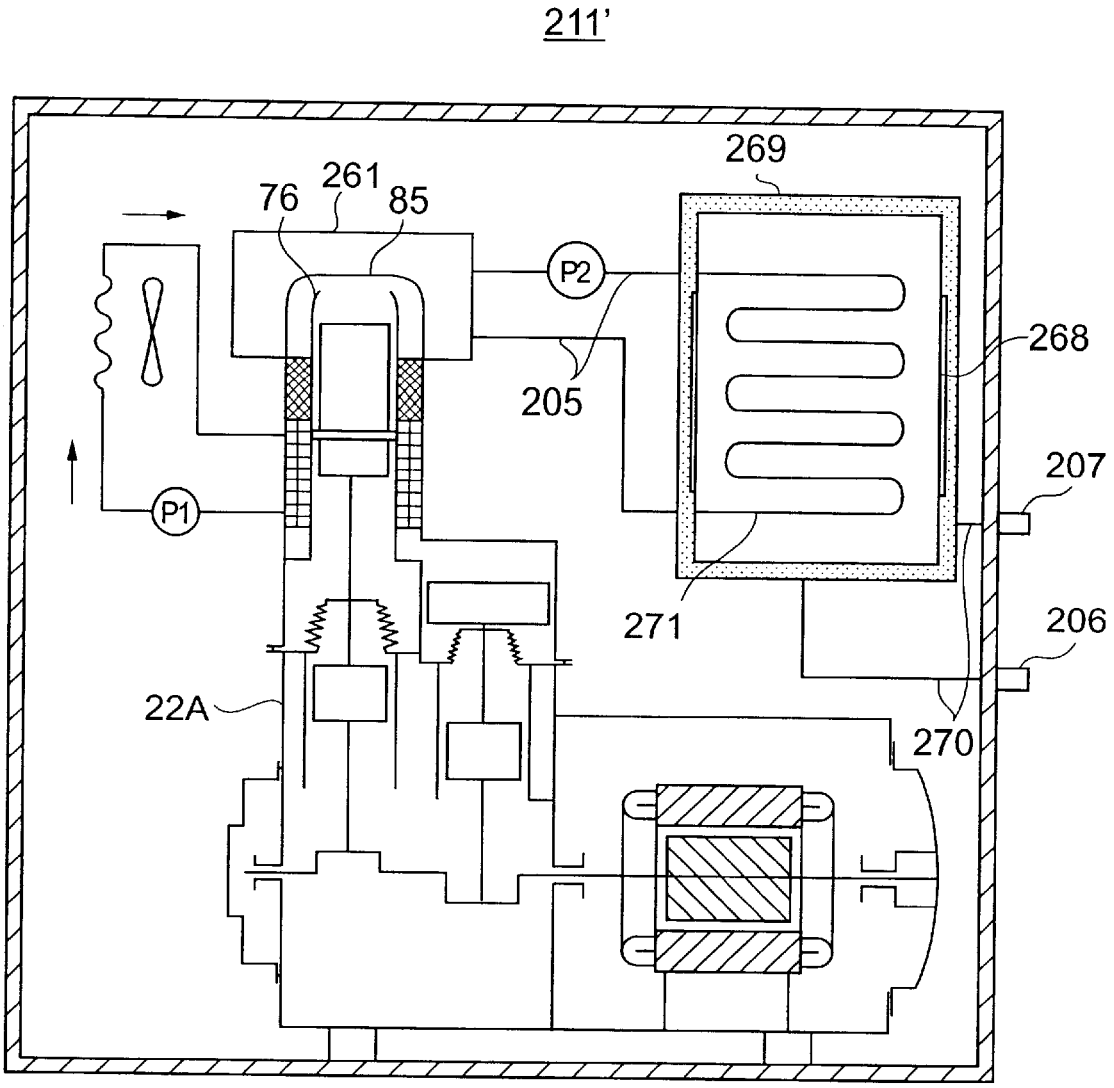
FIG. 21 is a diagram showing another embodiment of the isothermal fluid circulating device constituted using the Stirling cycle refrigerator of the present invention.

FIG. 21 shows another embodiment of the invention shown in FIG. 17. The structure of the Stirling cycle refrigerator 22A of the embodiment is the same as that of the embodiment of FIG. 17, but the inner constitution is shown in a simple manner (buffer tank 59, and the like are omitted). In an isothermal fluid circulating device 211' using the Refrigerator, by the cooling heat refrigerant (hereinafter referred to as the primary cooling heat refrigerant) cooled by the cold head 85 of the cooling heat exchanger 76, the secondary cooling heat refrigerant is cooled, and circulated in the cooling heat utilizing apparatus to perform the cooling action. For this purpose, there are provided a secondary cooling heat refrigerant Isothermal fluid storage tank 269 for storing the secondary cooling heat refrigerant and a secondary cooling heat refrigerant pipe line 270.

In the same manner as in the embodiment of FIG. 17, in the secondary cooling heat refrigerant isothermal fluid storage tank 269, a fluid storage tank wall is surrounded by an insulating wall, and a capacity is appropriately designed in accordance with the freezing ability of the freezer, purposes, and the like. For example, the capacity of about 10 to 20 liters is used. In the cooling heat refrigerant isothermal fluid storage tank 269, an agitating blade (not shown) for agitating the cooling heat refrigerant is rotatably disposed, so that the fluid temperature of the cooling heat refrigerant in the cooling heat refrigerant isothermal fluid storage tank 269 is uniformed.

The primary cooling heat refrigerant pipe lines 205 are connected. to a heat exchanger 271 in the secondary cooling heat refrigerant isothermal fluid storage tank 269 via the pump P2, to circulate the primary cooling heat refrigerant between the jacket 261 for cooling the cold head 85 and the secondary cooling heat refrigerant isothermal fluid storage tank 269. The secondary cooling heat refrigerant pipe lines 270 are connected to the outlet stopper 206 and the inlet stopper 207 from the secondary cooling heat refrigerant isothermal fluid storage tank 269, and the secondary cooling heat refrigerant is circulated between the secondary cooling heat refrigerant isothermal fluid storage tank 269 and the heat exchange pipeline of the cooling heat utilizing apparatus.

According to the embodiment, the secondary cooling heat refrigerant in the secondary cooling heat refrigerant isothermal fluid storage tank 269 is entirely cooled by the primary cooling heat refrigerant, and a part of the primary cooling heat refrigerant is circulated to the cooling heat utilizing apparatus by the secondary cooling heat refrigerant pipe line 270 to perform the cooling action, so that the temperature fluctuation of the secondary cooling heat refrigerant generated by the fluctuation of the operation state of the refrigerator 22A is suppressed. Even in the embodiment, the temperature control is performed by the temperature control device in the same manner as in the embodiment of FIG. 17.

Figure 22:
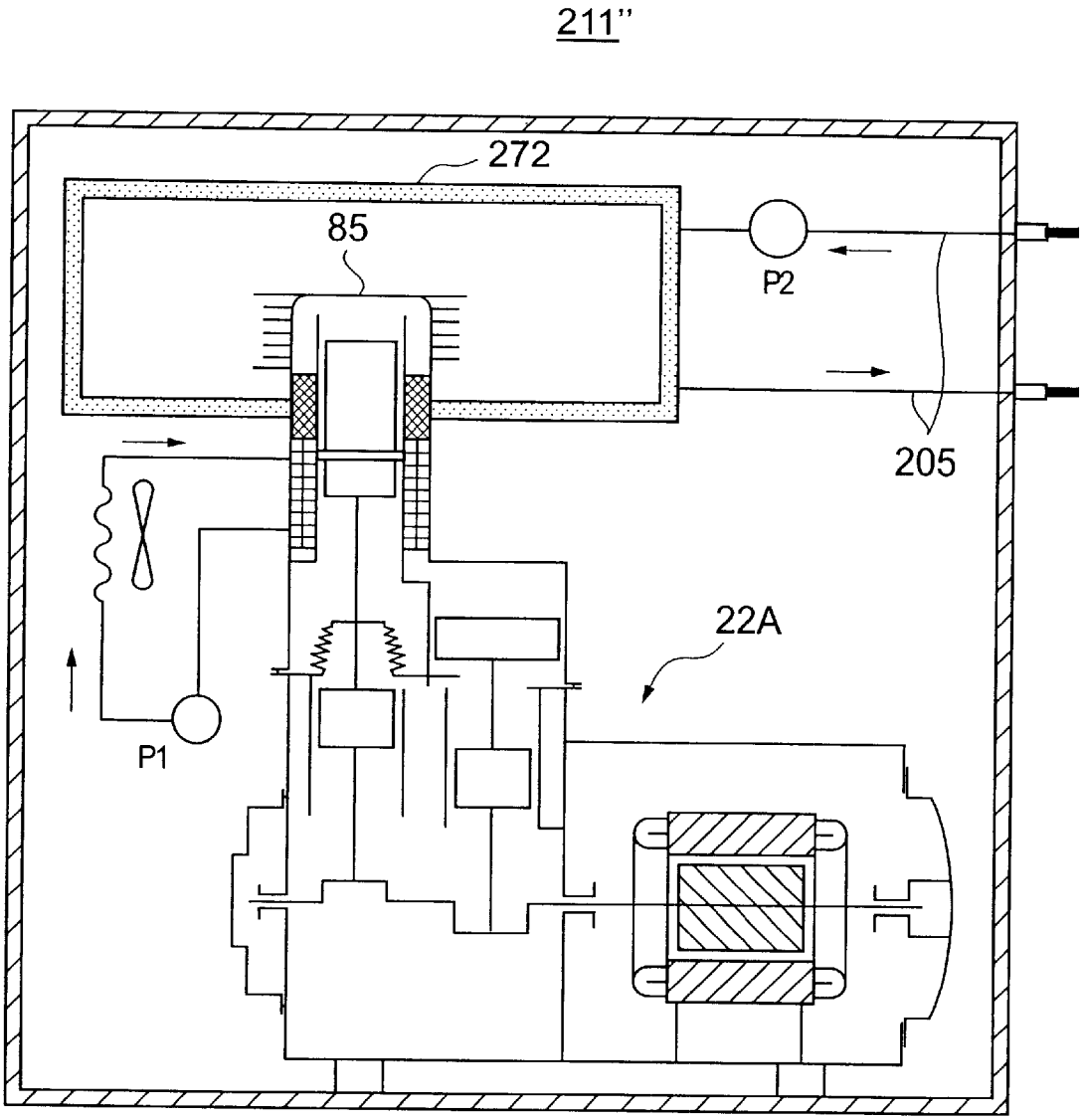
FIG. 22 is a diagram showing another embodiment of the isothermal fluid circulating device constituted using the Stirling cycle refrigerator of the present invention.

FIG. 22 shows further embodiment of the invention of FIG. 17. Also in the embodiment, the constitution of the refrigerator 22A itself is the same as that of the embodiment of FIG. 17, but in an isothermal fluid circulating device 211" using the Refrigerator, the cold head 85 is directly disposed in a cooling heat refrigerant Isothermal fluid storage tank 272.

Specifically, the cooling heat refrigerant is accommodated In the cooling heat refrigerant isothermal fluid storage tank 272, and the entire cooling heat refrigerant in the cooling heat refrigerant isothermal fluid storage tank 272 is directly cooled by the cold head 85. Additionally, the refrigerant is circulated on the side of the cooling heat utilizing apparatus by the cooling heat refrigerant pipe lines 205 and the pump P2 to perform the cooling action.

In the same manner as in the embodiment of FIG. 17, the cooling heat refrigerant isothermal fluid storage tank 272 is formed by surrounding the fluid storage tank wall with the insulating wall, and the capacity is appropriately designed in accordance with the freezing ability of the freezer, purposes, and the like. For example, the capacity of about 10 to 20 liters is used. In the cooling heat refrigerant isothermal fluid storage tank 272, an agitating blade (not shown) for agitating the cooling heat refrigerant is rotatably disposed, so that the fluid temperature of the cooling heat refrigerant in the cooling heat refrigerant isothermal fluid storage tank 272 is uniformed.

In the embodiment, since the cooling heat refrigerant isothermal fluid storage tank 272 is provided with both functions of the heat exchanger for cooling the cooling heat refrigerant and the buffer for suppressing the temperature fluctuation, the structure is extremely simplified. Moreover, since the cooling heat refrigerant is directly cooled, cooling effect is superior. Also in the embodiment, the temperature control is performed by the temperature control device in the same manner as in the embodiment of FIG. 17.

Additionally, in the above-described embodiment, the two-piston type Stirling cycle refrigerator has been used, but needless to say, a displacer type and other types of Stirling cycle refrigerators may be used.

In this case, the isothermal fluid circulating device 211 using the Stirling cycle refrigerator of the present invention can provide the following effects:

(8) Since the Stirling cycle refrigerator is used to constitute the isothermal fluid circulating device, by using refrigerants other than Freon, such as ethyl alcohol, nitrogen, helium and other low-melting refrigerants, as the operating gas, the isothermal fluid circulating device adaptable to the earth environmental problem can be realized. Additionally, the operation temperature is in a broader range as compared with the conventional cooling device, and particularly an ultra-low temperature range of −100 to −150° C. can be realized. The present invention can be applied to the cooling heat utilizing apparatus which is applied to the extensive range.

(9) Since the cooling heat refrigerant isothermal fluid storage tank is disposed for storing the cooling heat refrigerant, the cooling heat refrigerant in the fluid tank is cooled, and a part of the refrigerant is circulated in the cooling heat utilizing apparatus, the fluctuation of the cooling heat refrigerant is suppressed to maintain the constant temperature, and the operation at the constant temperature can be realized.

(10) The operation of the Refrigerator is controlled, and the cooling he-at refrigerant fluid-tank is provided with the electric heater, so that accurate temperature control is possible.

(11) The Stirling cycle refrigerator utilizing isothermal fluid circulating device can be realized making the most use of the properties of the Refrigerator which is compact, high in result coefficient, and excellent in energy efficiency.

Figure 23:
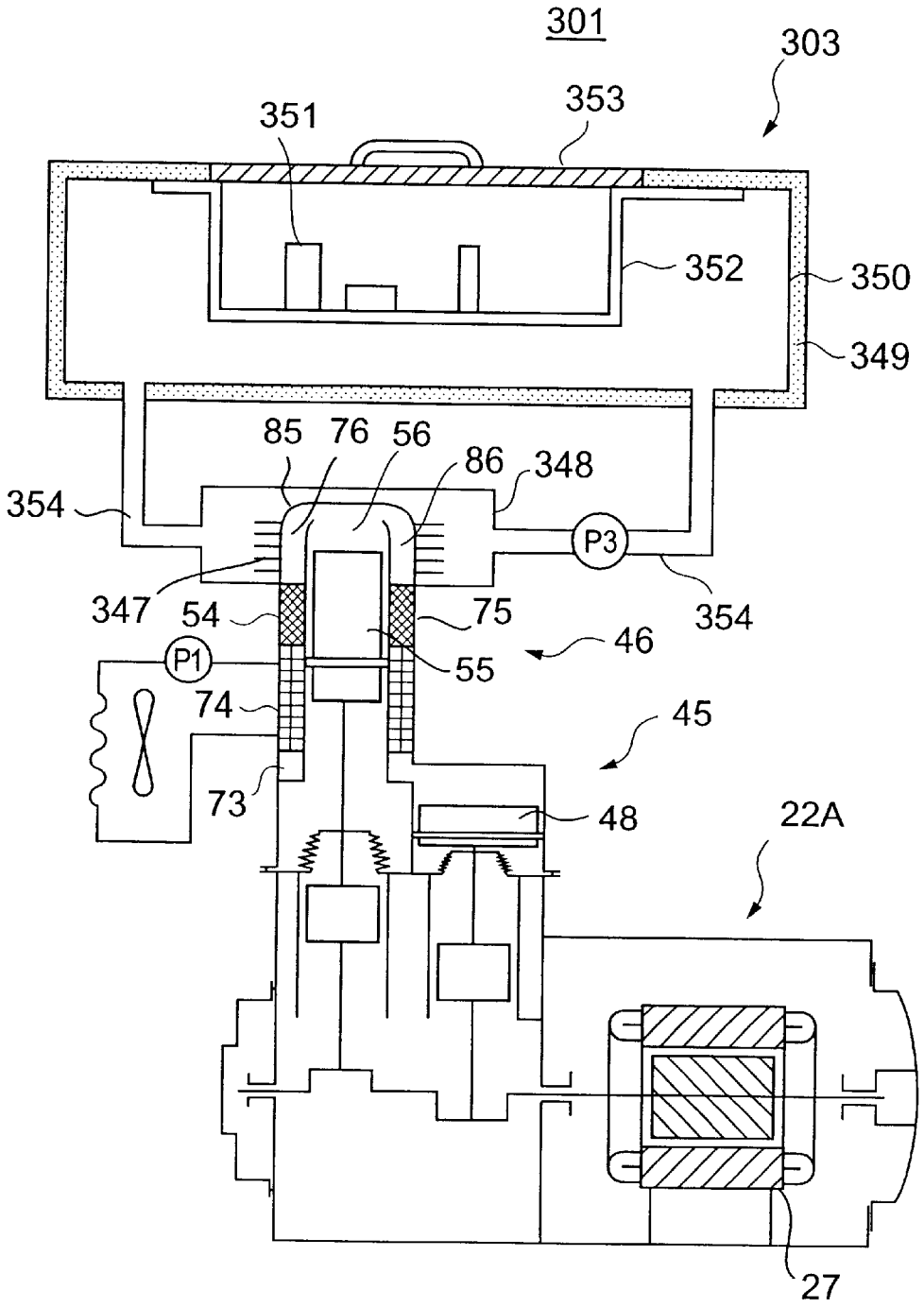
FIG. 23 is a diagram showing an embodiment of a heat shock tester constituted using the Stirling cycle refrigerator of the present invention.

Furthermore, FIG. 23 shows a heat shock tester 301 as a Stirling cycle device constituted using the above-described Refrigerator 22A of the first embodiment. Additionally, in the drawing the components shown with the same reference numerals as those in FIG. 2 are the same, and the Refrigerator 22A itself is shown in a simple manner. In the drawing, the heat shock tester 301 is constituted of the Refrigerator 22A, and a thermal property test, tank 303 in which cooling or heating is performed by the Refrigerator 22A.

Moreover, in this case, the cooling heat exchanger 76, formed in the top (cold head 85) of the expansion cylinder block 54 has an operating gas channel 86 formed inside the expansion cylinder block 54 and cooling fins 347 formed outside. A Jacket 348 is disposed to entirely cover the cold head 85, and an inlet and an outlet for cooling heat refrigerant are formed in the jacket 348.

The thermal property test tank 303 has a tank wall 350 which is surrounded by an Insulating wall 349 from the outside and which is formed of a metal material or the like, and an inlet and an outlet of cooling heat refrigerant are formed. Inside the thermal property test tank 303, a sealed storage case 352 is partitioned/formed for storing a test object 351 such as an electronic component to be subjected to the thermal property test. The top of the storage case 352 is opened, and a lid 353 is openably/closably attached to close the opening.

When the cooling heat refrigerant such as air, nitrogen, and helium is circulated between the thermal property test tank 303 and the cold head 85 for use, the storage case 352 may be structured by forming vent holes in the wall or by using lattice-shaped members. Alternatively, no storage case 352 may be disposed. In the structures, the circulating cooling heat refrigerant directly contacts the test object to directly cool or heat the object.

The outlet of the jacket 348 is connected to the inlet of the thermal property test tank 303 via a cooling heat refrigerant pipe line 354 and a pump P3, and the inlet of the Jacket 348 is connected to the outlet of the thermal property test tank 303 via the cooling heat refrigerant pipe line 354. Thereby, the cooling heat refrigerant circulates and flows between the jacket 348 and the thermal property test tank 303. As the cooling heat refrigerant, ethyl alcohol, HFE, PFC, PFG, air, nitrogen, helium, and the like are used.

Figure 26:
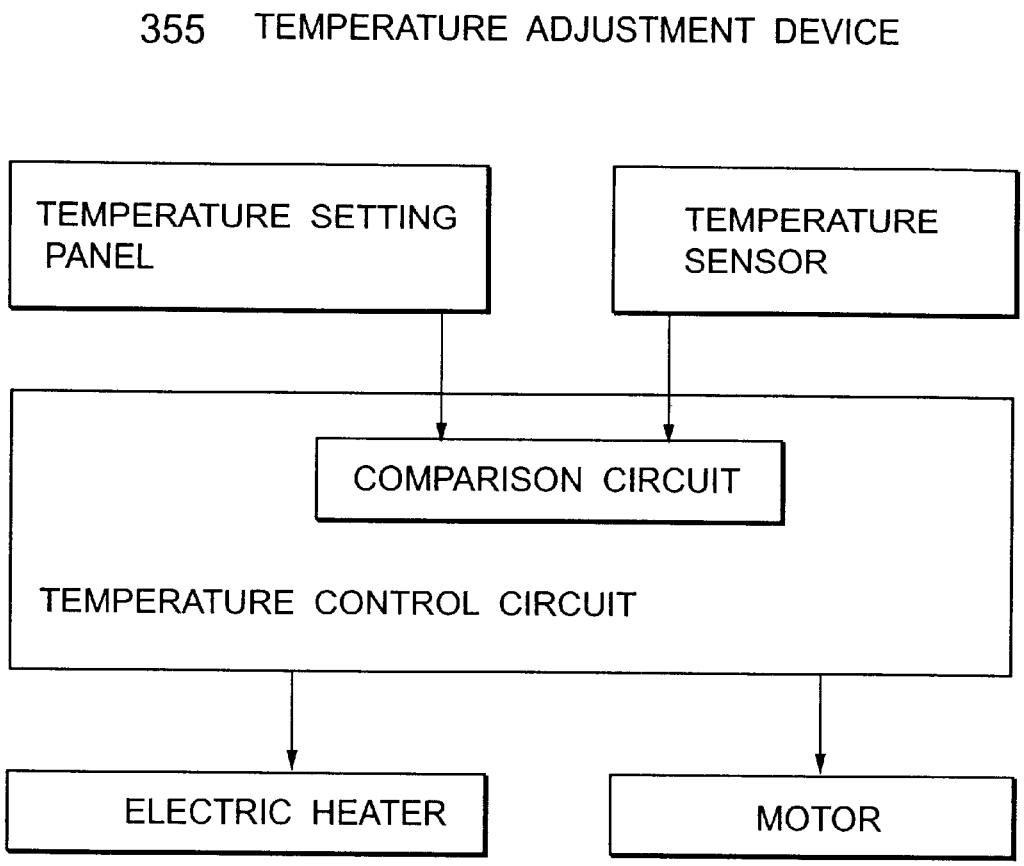
FIG. 26 is an explanatory view of the temperature adjustment device of the heat shock tester constituted using the Stirling cycle refrigerator of the present invention.

FIG. 26 shows a temperature adjustment device 355 of the heat shock tester 301. The temperature adjustment device 355 has a temperature setting panel, a temperature control device for making possible temperature setting by the temperature setting panel, and a temperature sensor disposed in the thermal property test tank 303 or the storage case 352.

In a comparison circuit in a temperature control circuit constituting the temperature control device 355, the temperature signal in the storage case 352 detected by the temperature sensor and the set temperature are compared, it is judged whether or not the temperature is in the allowable temperature range centering on the set temperature, and according to a result, the motor 27 is PID controlled or the motor 27 is rotated forward or in reverse to maintain the set temperature while the operation is performed.

Furthermore, when the thermal property test tank 303 is provided with an electric heater, in addition to the temperature control by the operation control of the motor 27 of the Refrigerator 22A, by PID controlling and heating the electric heater, a more precise temperature control can be performed.

Further-more, the action of the heat shock tester 301 according to the above-described embodiment of the present Invention will next be described. When the Refrigerator 22A is operated, and the compression piston 48 slowly moves in the vicinity of the upper dead point as described above, the expansion piston 55 rapidly moves toward the lower dead point, and the operating—gas flowing into the low temperature chamber (expansion space) 56 Is rapidly expanded, thereby generating cooling heat. Thereby, the cold head 85 surrounding the low temperature chamber (expansion space) 56 is cooled to reach a low temperature.

This is the case where the refrigerator 22A is cooled/operated to place the thermal property test tank 303 in a low temperature state. When the heating/operating is performed to place the thermal property test tank 303 in a high temperature state, the motor 27 is rotated in reverse. Then, as described above, the expansion cylinder 55 acts as the compression cylinder, the compression cylinder 48 acts as the expansion cylinder, the cooling heat exchanger 76 functions as a radiating heat exchanger, and the cold head 85 reaches a high temperature. Thereby, the cooling heat refrigerant is heated to reach a high temperature, and circulated in the jacket 348 and the thermal property test tank 303 to raise the temperature of the test object.

By switching the forward rotation and reverse rotation of the motor 27 in this manner, the cooling operation and heating operation of the refrigerator are switched, and the temperature of the thermal property test tank 303 is lowered or raised, so that a low temperature state and a high temperature state can rapidly be changed, and a heat shock by a temperature change can be applied to the test object.

The temperature added to the test object 351 in the thermal property test tank 303 is set by the temperature setting panel of the temperature adjustment device 355. Depending on whether the set temperature is in a low temperature area or a high temperature area, the motor 27 is controlled to rotate forward or in reverse by the temperature control circuit.

Subsequently, while the Refrigerator 22A is operated, the temperature in the thermal property test tank 303 is detected by the temperature sensor, the detected temperature and the temperature set by the temperature setting panel are compared in the comparison circuit in the temperature control circuit constituting the temperature control device, and it is judged whether or not the temperature is in the allowable temperature range centering on the set temperature. According to the result, the motor 27 of the refrigerator 22A is controlled. In some cases (in the case where there is a large temperature difference between the set temperature and the detected temperature, and other cases), the rotating direction of the motor 27 is switched to rapidly raise or lower the temperature, and the operation is performed while maintaining the set temperature.

Furthermore, since the thermal property test tank 303 is provided with the electric heater, in addition to the temperature control by the operation control of the motor 27 of the refrigerator 22A, by controlling and heating the electric heater, a more precise temperature control is also possible.

Additionally, when the frost generated in the cold head 85 and thermal property test tank 303 is removed, the frost is detected by the frost sensor disposed in these places. By the defrosting control circuit, heating is performed by the electric heater disposed in the thermal property test tank 303 to perform defrosting. Additionally, by rotating the motor 27 of the Refrigerator 22A forward and in reverse, the temperature of the cold head 85 is raised, and defrosting can rapidly and effectively be performed.

Figure 24:
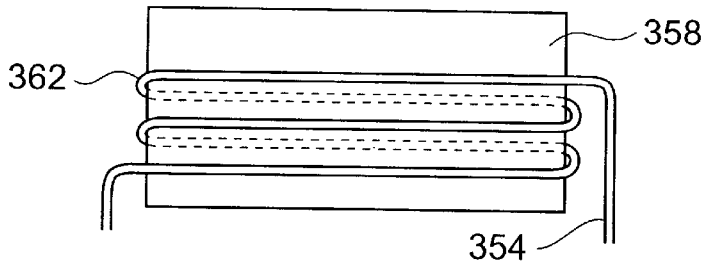
FIGS. 24*a* and 24*b* are diagrams showing another embodiment of the heat shock tester constituted using the Stirling cycle refrigerator of the present invention.
Figure 24:
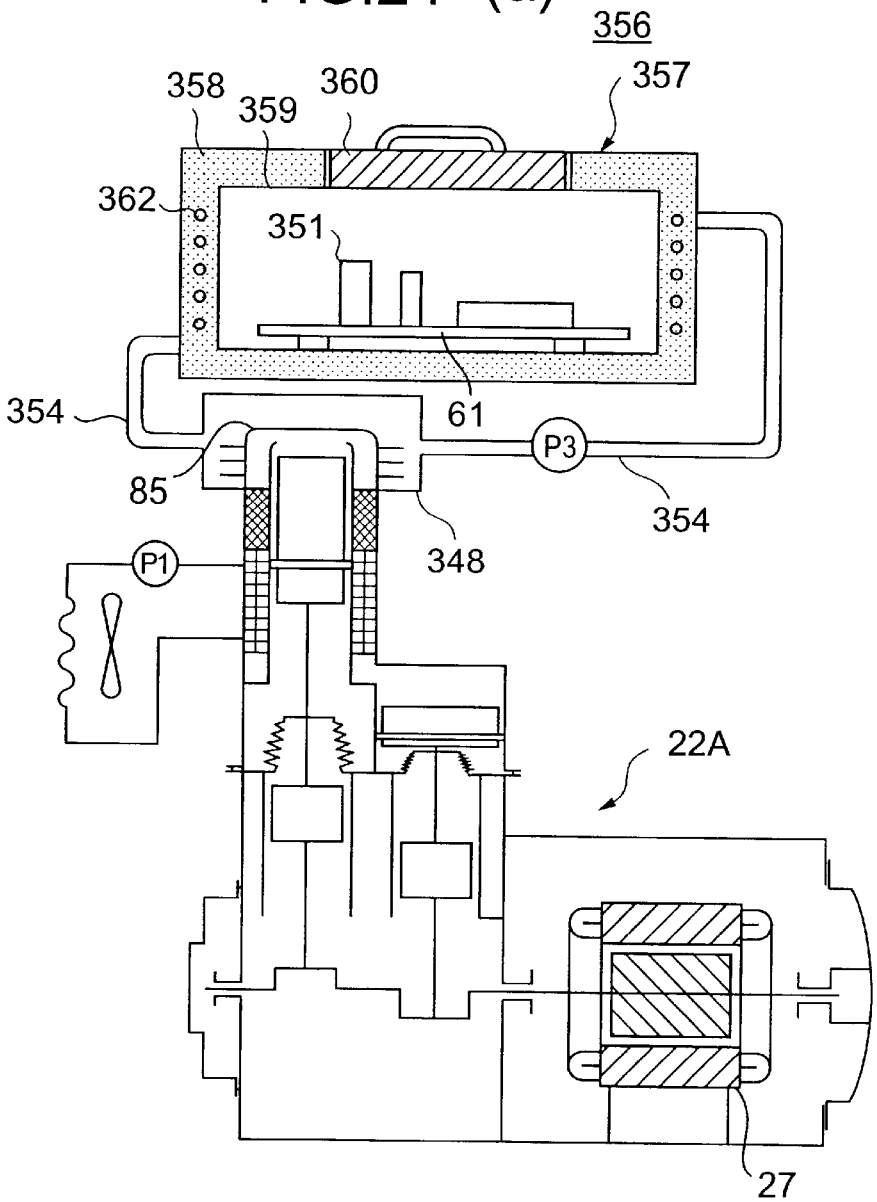

FIG. 24 shows another embodiment of the Invention of FIG. 23. In a heat shock tester 356 shown in FIG. 24*a,* the Refrigerator 22A is the same as that of the embodiment of FIG. 23, but the structure of the thermal property test tank is different. In the same manner as FIG. 23, a thermal property test tank 357 has a tank wall 359 formed of a metal material or the like surrounded by an insulating wall 358 from the outside, an upper opening is provided with an openable/closable lid 360, and a shelf 361 on which the test object 351 is to be laid is disposed inside. Around the tank wall 359 of the thermal property test tank 357, as shown in FIG. 24*b,* a heat exchanging coil 362 is wound and connected to the cooling heat refrigerant pipe line 354.

In the heat shock tester 356 of the embodiment, the cooling heat refrigerant cooled by the cold head 85 is fed through the cooling heat refrigerant pipe line 354 via the pump P3, and the inside of the thermal property-test tank 357 is cooled or heated by the heat exchanging coil 362. By providing the thermal property test tank 357 with the temperature sensor, the temperature adjustment can be performed in the same manner as in the embodiment of FIG. 23.

Figure 25:
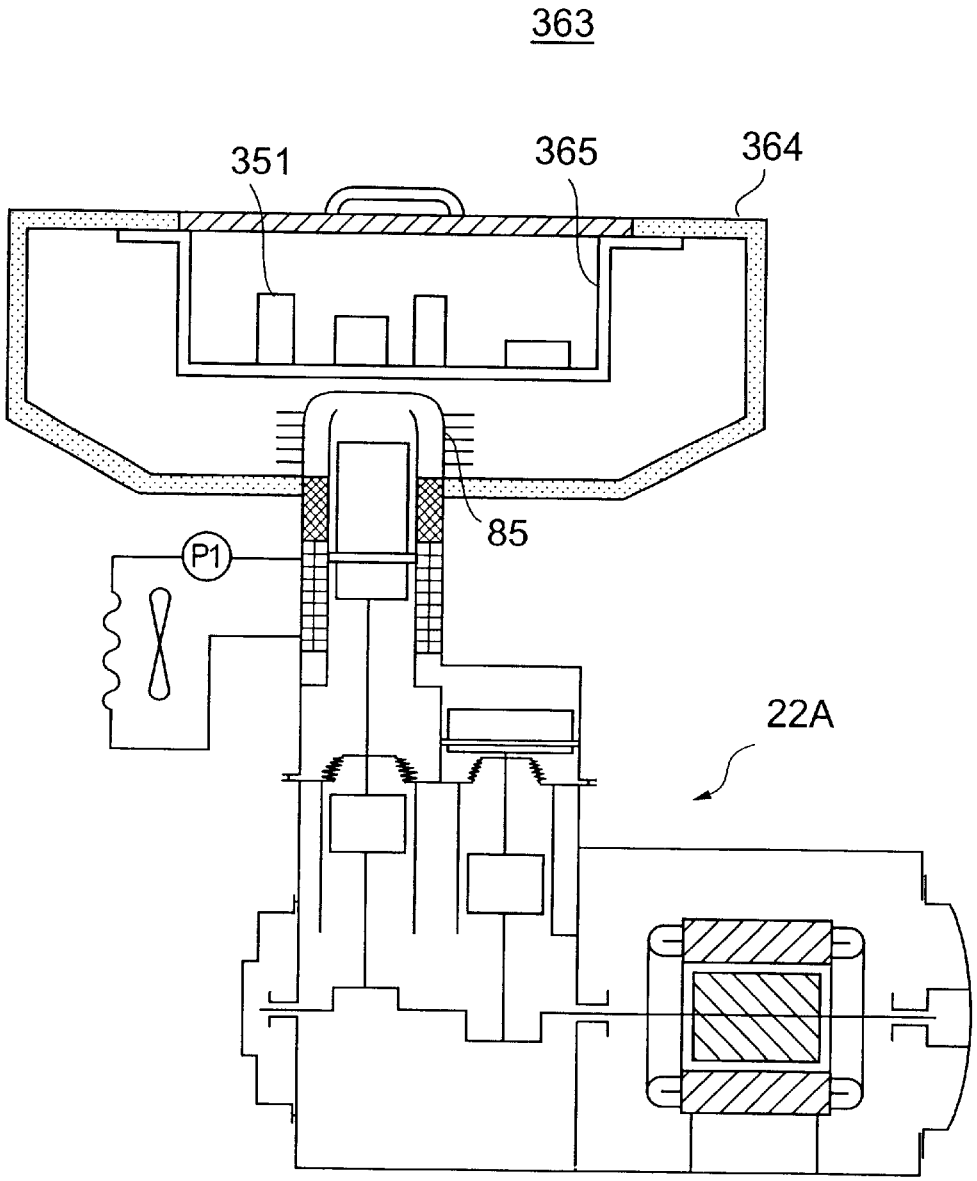
FIG. 25 is a diagram showing further embodiment of the heat shock tester constituted using the Stirling cycle refrigerator of the present invention.

FIG. 25 shows further embodiment of the invention of FIG. 23. Also with respect to a heat shock tester 363 in the embodiment, the Refrigerator 22A is the same as the Refrigerator 22A of the embodiment of FIG. 23, but the structure of a thermal property test tank 364 is different. The thermal property test tank 364 has a tank wall formed of a metal material or the like surrounded by an insulating wall in the same manner as in the embodiment of FIG. 23.

However, the cold head 85 of the Refrigerator 22A is disposed in the thermal property test tank 364 so as to directly pass through the bottom of the thermal property test tank 364. The thermal property test tank 364 is provided with a lattice-shaped shelf plate 365 on which the test object 351 is to be laid. Without disposing the shelf plate 365, the test object 351 may be directly laid on the upper surface of the cold head 85 and directly cooled or heated. Moreover, instead of the shelf plate 364, the storage case as shown in the embodiment of FIG. 23 may be disposed in the thermal property test tank 364. In the heat shock tester 363 of the embodiment, by providing the thermal property test tank 364 with the temperature sensor, the temperature adjustment can be performed in the same manner as in the embodiment of FIG. 23. In the heat shock tester 363, since the cold head 85 is directly disposed in the thermal property test tank 364, the cooling/heating effect in the thermal property test tank 364 is superior.

The invention constituted as described above provides the following effects:

(12) Since cooling/heating can be performed by rotating the motor of the Refrigerator 22A forward and in reverse, different from the prior art, the compact heat shock tester simple in structure and low in cost can be realized without combining the independent refrigerating device and heating device.

(13) The broad temperature range in the low and high temperatures can be realized, and the cooling and heating of the cold head 85 can rapidly be switched by the forward or reverse rotation. By noting and utilizing these properties of the Refrigerator 22A, the thermal property test In the broad temperature area and the rapid raising/lowering of the temperature, which have recently been desired in the heat shock tester, can be realized. Particularly, the thermal property test in the ultra-low temperature area of liquid nitrogen level (the vicinity of −200° C.) is also possible.

(14) Since the refrigerants other than the conventional Freon can be used, the heat shock tester adaptable to the earth environmental problem, high in result coefficient, and excellent in energy efficiency can be realized.

Figure 27:
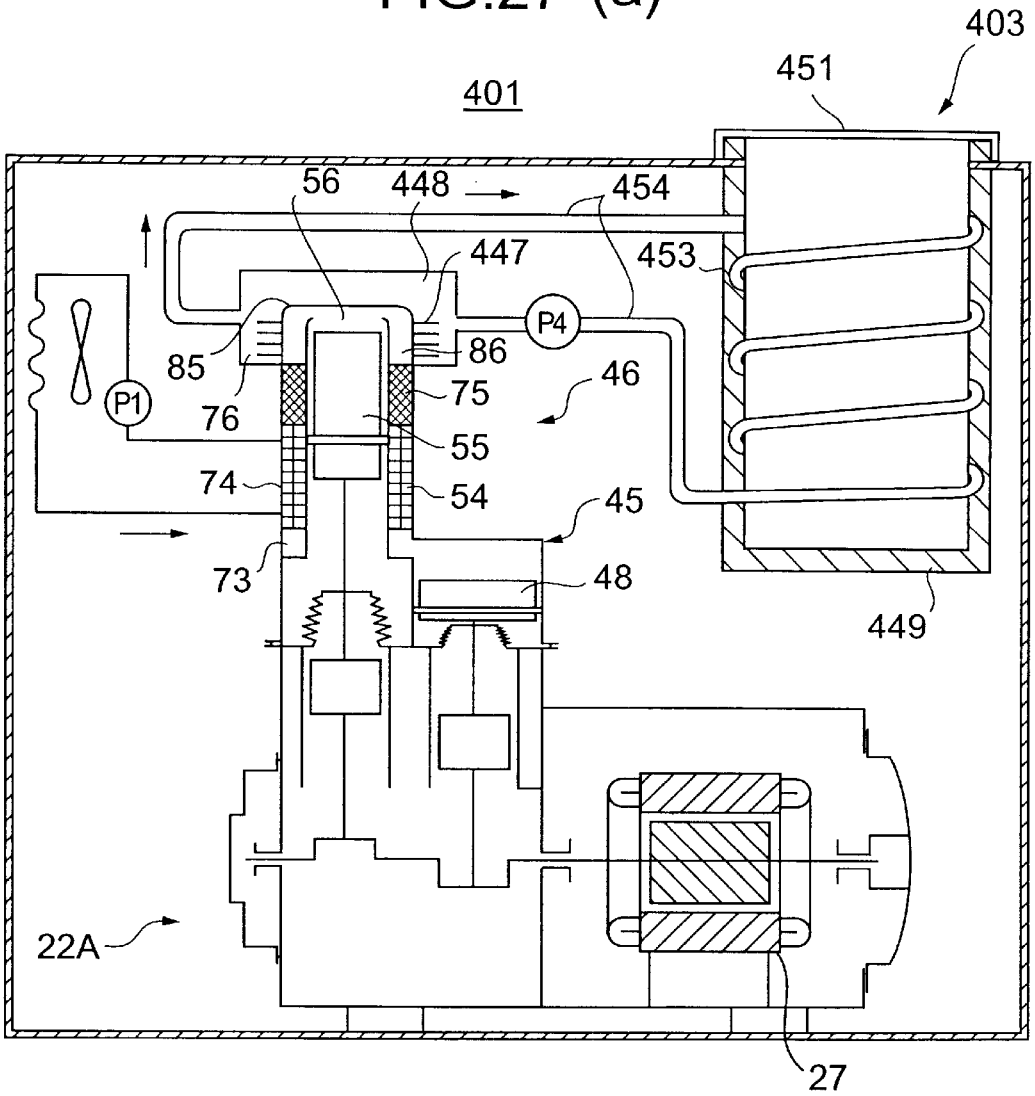
FIGS. 27*a* and 27*b* are diagrams showing an embodiment of a freezing drier constituted using the Stirling cycle refrigerator of the present invention.
Figure 27:
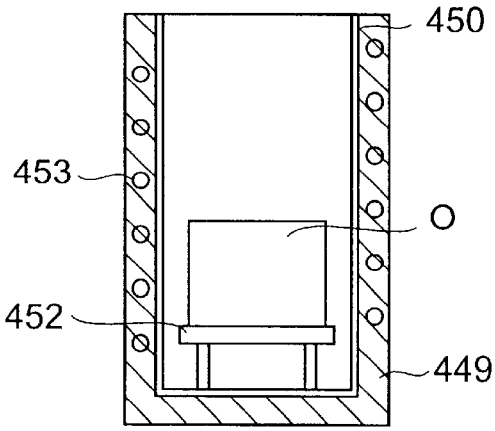

Furthermore, FIG. 27 shows one embodiment of a freezing drier 401 as the Refrigerator which is constituted using the Refrigerator 22A of FIG. 2. In the drawing, the freezing drier 401 is constituted of the Refrigerator 22A, and a freezing/drying tank 403 cooled or heated by the Refrigerator 22A.

In this case, the cooling heat exchanger 76 formed on the top (cold head 85) of the expansion cylinder block 54 has the operating gas channel 86 formed inside the expansion cylinder block 54 and cooling fins 447 formed outside. A jacket 448 is disposed to entirely surround the cold head 85, and an inlet and an outlet for the cooling heat refrigerant are formed in the jacket 448.

As shown in FIG. 27*b,* the freezing/drying tank 403 has a tank wall 450 formed of a metal material or the like surrounded by an insulating wall 449 from the outside, an upper opening is provided with an openable/closable lid 451, and a shelf 452 on which an object to be dried 0 is disposed inside. A heat exchanging coil 453 is wound around the tank wall 450 of the freezing/drying tank 403, and connected to a cooling heat refrigerant pipe line 454.

The cooling heat refrigerant pipe lines 454 connect the jacket 448 and the heat exchanging coil 453 via a pump P4, to circulate the cooling heat refrigerant between the cooling heat refrigerant pipe line 454 and the jacket 448. As the cooling heat refrigerant, ethyl alcohol,.HFE, PFC, PFG, nitrogen, helium, and the like are used.

Figure 31:
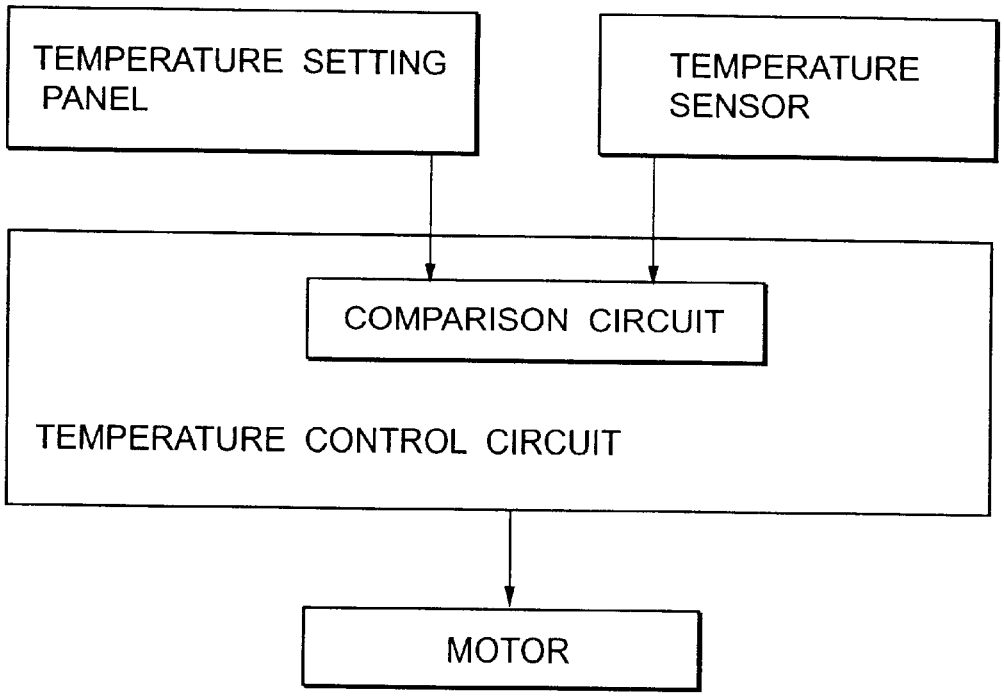
FIG. 31 is an explanatory view of the temperature adjustment device of the freezing drier constituted using the Stirling cycle refrigerator of the present invention.

FIG. 31 shows a temperature adjustment device 455 of the freezing drier of the invention. The temperature adjustment device 455 has a temperature setting panel for setting a freezing temperature in accordance with drying purposes, and the like, a temperature control device for making possible the temperature setting by the temperature setting panel, and a temperature sensor disposed in the freezing/drying tank 403. In a comparison circuit in the temperature control circuit constituting the temperature control device 455, the temperature signal in the freezing/drying tank 403 detected by the temperature sensor is compared with the set temperature, it is judged whether or not the temperature is in an allowable temperature range centering on the set temperature, and according to a result, the motor 27 is PID controlled. Alternatively, by rotating the motor 27 in reverse or forward, the operation is performed while maintaining the set temperature.

The action of the freezing drier 401 according to the above-described embodiment of the present invention will next be described. As described above, when the compression piston 48 slowly moves in the vicinity of the upper dead point, the expansion piston 55 rapidly moves toward the lower dead point, and the operating gas flowing into the low temperature chamber (expansion space) 56 is rapidly expanded, thereby generating cooling heat. Thereby, the cold head 85 surrounding the low temperature-chamber (expansion space) 56 is cooled and has a low temperature.

The cooling heat refrigerant cooled by the cold head 85 is fed to the cooling coil 453 from the jacket 448 via the cooling heat refrigerant pipe line 454. Thereby, the freezing/drying tank 403 is cooled, the moisture in the tank is frozen, and the inside of the tank is placed in a dry state. The object to be dried 0 is dried in the freezing/drying tank 403.

Additionally, when adhering frost is removed during the cleaning or the like in the freezing/drying tank 403, the motor 27 is reversed. Then, as described above, the expansion cylinder 46 acts as the compression cylinder, the compression cylinder 45 acts as the expansion cylinder, the cooling heat exchanger 76 functions as the radiating heat exchanger, and the cold head 85 reaches a high temperature. Subsequently, the cooling heat refrigerant is heated and circulated in the jacket 448 and the freezing/drying tank 403. Thereby, the temperature inside the freezing/drying tank 403 is raised, and the frost frozen on the inner wall, and the like, and the frost of the cold head can be removed. Therefore, even when the electric heater, and the like are not particularly attached, defrosting can effectively be performed.

Figure 28:
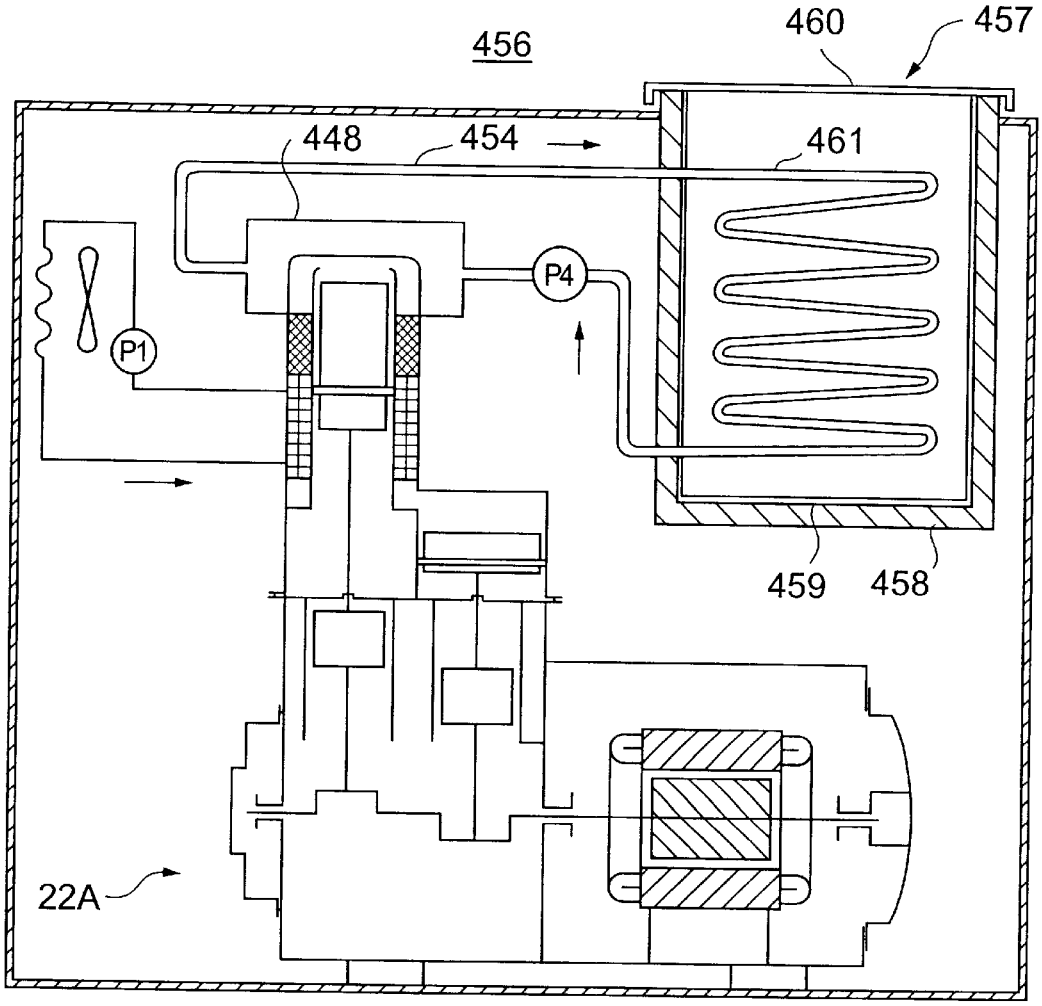
FIGS. 28*a* and 28*b* are diagrams showing another embodiment of the freezing drier constituted using the Stirling cycle refrigerator of the present invention.
Figure 28:
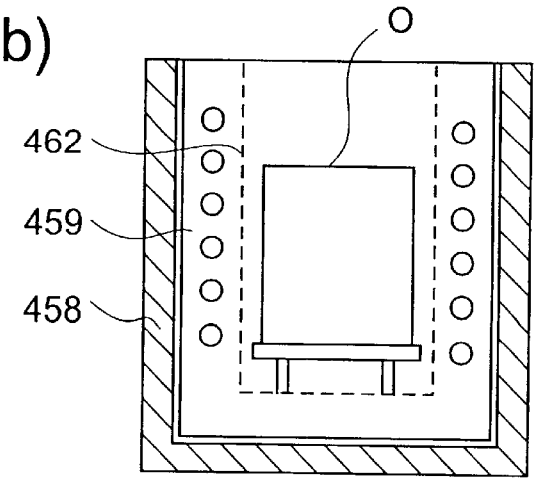

Subsequently, while the Refrigerator 22A is operated, the temperature in the freezing/drying tank 403 is detected by the temperature sensor, the detected temperature is compared with the temperature set by the temperature setting panel in the comparison circuit in the temperature control circuit constituting the temperature control device, and it is judged whether or not the temperature is in the allowable temperature range centering on the set temperature. According to the result, the motor 27 of the Refrigerator 22A is PID controlled. In some cases (in the case where there is a large temperature difference between the set temperature and the detected temperature, and in other cases), the rotating direction of the motor 27 is switched to rapidly raise or lower the temperature, and the operation is performed while maintaining the set temperature. FIG. 28 shows another embodiment of the invention. FIG. 28*a* shows the entire structure, and FIG. 28*b* shows the main part structure of the freezing/drying tank. In a freezing drier 456, the structure of the Refrigerator 22A is the same as that of the embodiment of FIG. 27, the description thereof is omitted, but the structure of a freezing/drying tank 457 is different. In the same manner as in the embodiment of FIG. 27, the freezing/drying tank 457 has a tank wall 459 formed of a metal material, or the like surrounded by an insulating wall 458 from the outside, and the upper opening is provided with an openable/closable lid 460. Inside the tank wall 459, a heat exchanging coil 461 is wound and connected to the cooling heat refrigerant pipe line 454. Furthermore, inside the heat exchanging coil 461, a lattice or metal mesh-shaped support shelf 462 for supporting the object to be dried 0 is disposed.

In the freezing drier 456 of the embodiment, the cooling heat refrigerant cooled by the cold head 85 is fed to the heat exchanging coil 461 from the jacket 448 via the pump P4 through the cooling heat refrigerant pipe line 454. Thereby, the freezing/drying tank 457 is cooled, the moisture in the tank is frozen, and the inside of the tank is placed in a dry state. The object to be dried 0 is dried in the freezing/drying tank 457.

Figure 29:
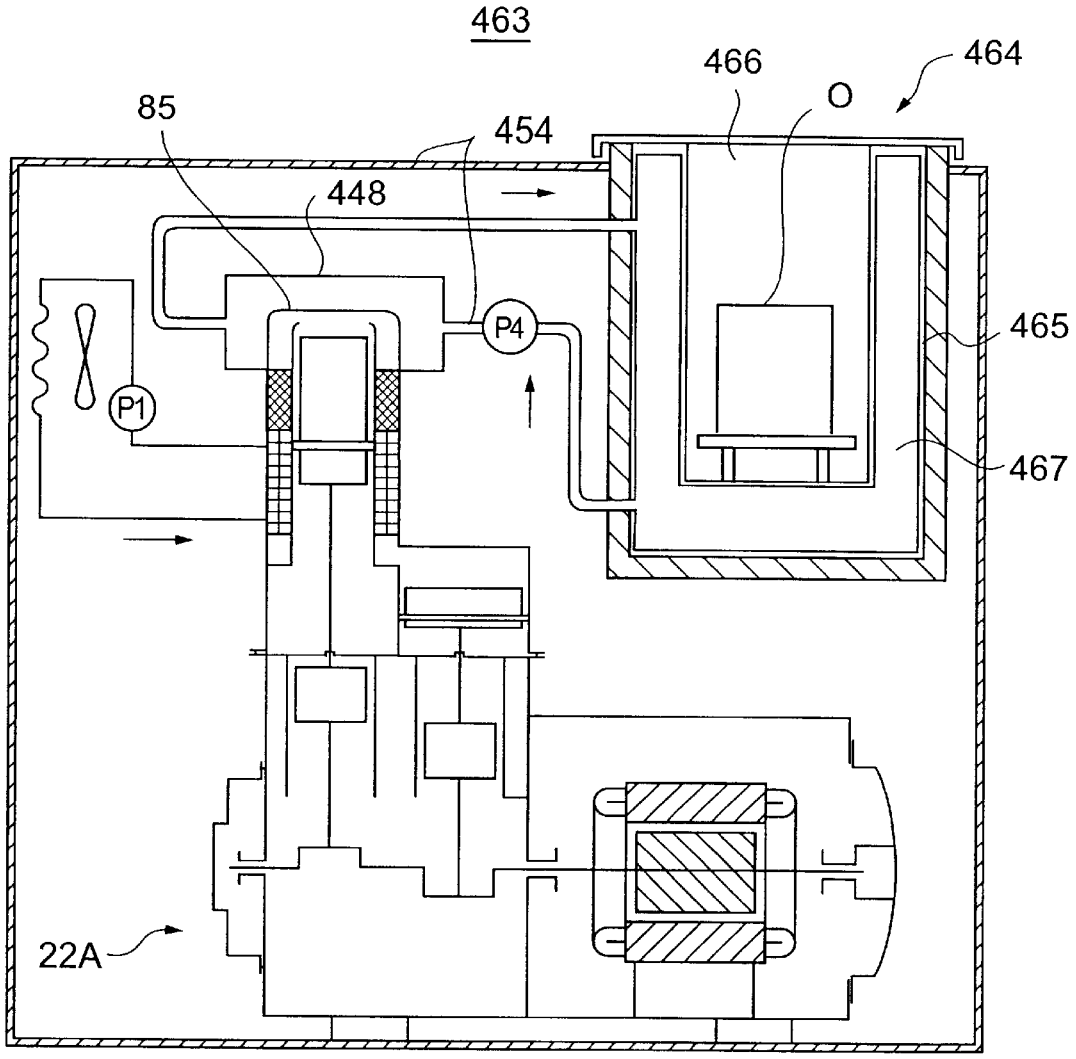
FIG. 29 is a diagram showing further embodiment of the freezing drier constituted using the Stirling cycle refrigerator of the present invention.

FIG. 29 shows another embodiment of the invention. Also with respect to a freezing drier 463 in the embodiment, the refrigerator 22A is the same as the refrigerator 22A of the embodiment of FIG. 27, the description thereof is omitted, but the structure of a freezing/drying tank 464 is different. In the same manner as in the embodiment of FIG. 27, the freezing/drying tank 464 has a tank wall 465 formed of a metal material, or the like surrounded by an insulating wall. A storage chamber 466 for accommodating the object to be dried 0 is formed inside the tank wall 465. Between the tank wall 465 and the storage chamber 466, a cooling heat refrigerant tank 467 is formed and connected to the cooling heat refrigerant pipe line 454, and filled with the cooling heat refrigerant.

In the freezing drier 463 of the embodiment, the cooling heat refrigerant cooled by the cold head 85 is fed to the cooling heat refrigerant tank 467 from the jacket 448 through the cooling heat refrigerant pipe line 454. Thereby, the storage chamber 466 is cooled, the moisture In the storage chamber 466 is frozen, and the inside of the tank is placed in a dry state.

Figure 30:
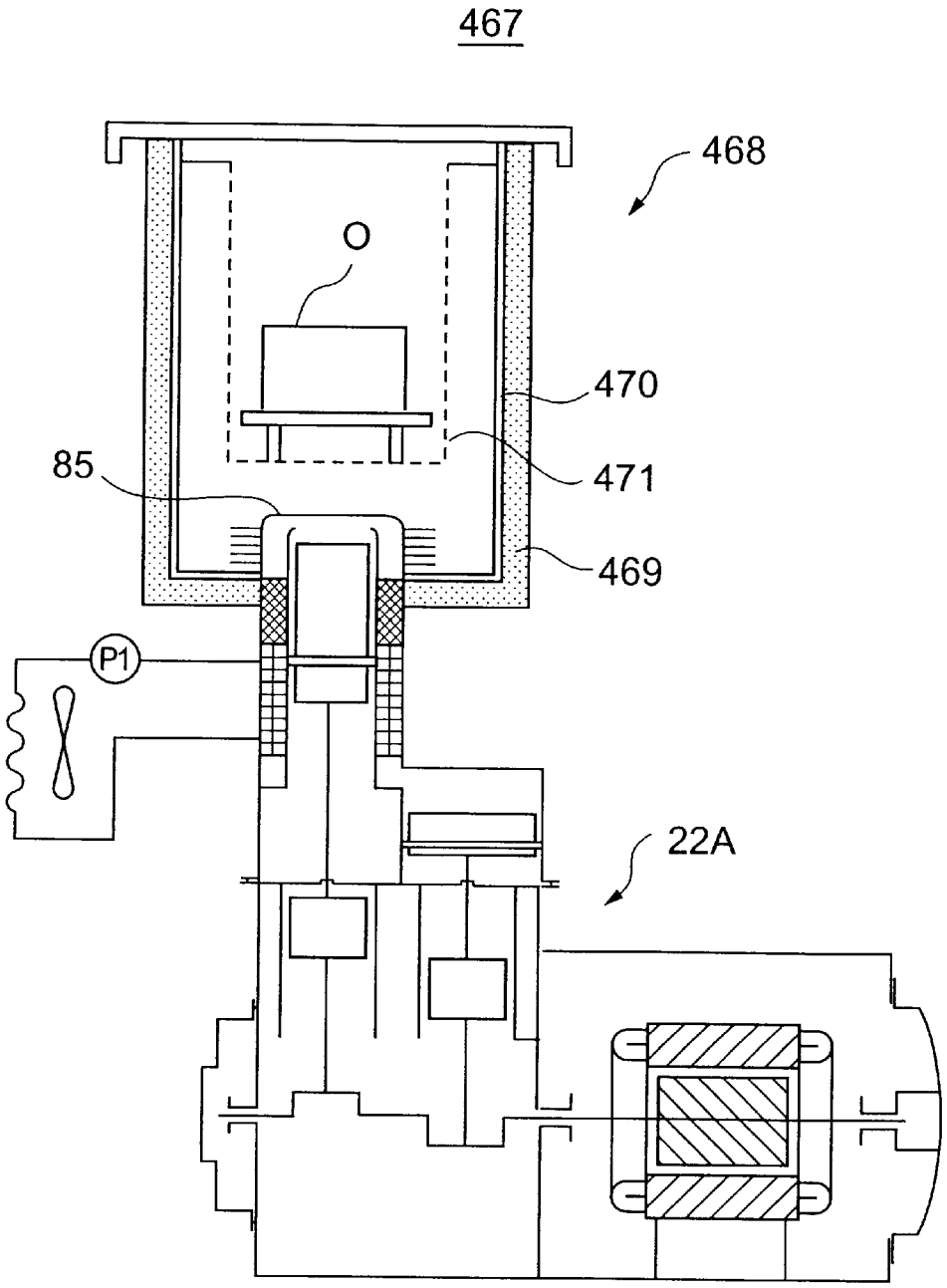
FIG. 30 is a diagram showing still another embodiment of the freezing drier constituted using the Stirling cycle refrigerator of the present invention.

FIG. 30 shows still another embodiment of the invention. Also with respect to a freezing drier 467 in the embodiment, the refrigerator 22A is the same as the refrigerator 22A of the embodiment of FIG. 27, the description thereof is omitted, but the structure of a freezing/drying tank is different. In the same manner as in the embodiment of FIG. 27, a freezing/drying tank 468 has a tank wall 470 formed of a metal material, or the like surrounded by an insulating wall 469. Then, the cold head 85 of the Refrigerator 22A is disposed in the freezing/drying tank 467 so as to directly pass through the bottom of the freezing/drying tank 467. In the freezing/drying tank 467, a lattice or metal mesh-shaped support shelf 471 on which the object to be dried 0 is to be laid, or the storage chamber similar to that of FIG. 29 is disposed. storage chamber 466 is frozen, and the inside of the tank is placed in a dry state.

FIG. 30 shows still another embodiment of the invention. Also with respect to a freezing drier 467 in the embodiment, the refrigerator 22A is the same as the refrigerator 22A of the embodiment of FIG. 27, the description thereof is omitted, but the structure of a freezing/drying tank is different. In the same manner as in the embodiment of FIG. 27, a freezing/drying tank 468 has a tank wall 470 formed of a metal material, or the like surrounded by an insulating wall 469. Then, the cold head 85 of the refrigerator 22A is disposed in the freezing/drying tank 467 so as to directly pass through the bottom of the freezing/drying tank 467. In the freezing/drying tank 467, a lattice or metal mesh-shaped support shelf 471 on which the object to be dried 0 is to be laid, or the storage chamber similar to that of FIG. 29 is disposed.

In the freezing drier 467 of the embodiment, by providing the freezing/drying tank 468 with the temperature sensor, the temperature adjustment is possible in the freezing drier 468 in the same manner as in the embodiment of FIG. 27. Since the cold head 85 is directly disposed in the freezing/drying tank 468, the freezing drier 467 is superior in cooling effect in the freezing/drying tank 468.

The invention constituted as described above provides the following effects:

(15) By employing the Stirling cycle refrigerator, the complete dry state by the ultra-low temperature area (about minus hundred and several tens ° C.) which is further lower than the conventional freezing temperature area can be realized. Moreover, particularly without disposing the heating device or the like, the temperature is raised for thawing by reversing the motor, and the dry state can rapidly be changed, so that the drier can be used for the environmental test or the cleaning.

(16) Without requiring a two-dimensional or two stage freezing system or other complicated structures, a simple, compact and inexpensive freezing drier can be realized.

(17) Since the refrigerants other than the conventional Freon can be used, the freezing drier adaptable to the earth environmental problem, high in result coefficient, and excellent in energy efficiency can be realized.

What is claimed is:

1. A Stirling cycle device, comprising:

housing having a crank chamber;

cylinder disposed above and adjacent to said crank chamber;

piston for reciprocating in said cylinder to compress or expand operating gas, or a displacer;

piston rod operatively connected to a crank in said crank chamber and having one end connected to said piston, or the displacer; and an oil seal disposed in an opening in a top of said crank chamber through which said piston rod is passed, wherein said oil seal comprises oil sealing bellows whose tip end is fixed to said piston rod in said cylinder and whose base end is fixed to a peripheral edge of the opening in the top of said crank chamber provided with said piston rod passed therethrough, and by disposing the oil sealing bellows, oil is inhibited from entering said cylinder via a space in said housing.

2. The Stirling cycle device according to claim 1, wherein between a space on the side of a back surface of said piston for compressing or expanding said operating gas and the space in said housing, a buffer tank for absorbing a pressure fluctuation in the space on said back surface side, and a pressure rise in said housing is connected via connecting means, and inside said buffer tank, pressure adjusting bellows are disposed to divide the buffer tank into a chamber on the side of an opening of the pressure adjusting bellows and a chamber on the side of a closing wall, and said chamber on the side of the opening and the chamber on the side of the closing wall are connected to either one of said space on the back surface side of the piston and said space in the housing.

3. The Stirling cycle device according to claim 1, wherein said space on the back surface side of the piston for compressing or expanding the operating gas and said space in the housing are connected via an oil trapping device to absorb the pressure fluctuation of said space on the back surface side.

4. The Stirling cycle device according to claim 1, wherein in said space on the back surface side of the piston for compressing or expanding the operating gas, the buffer tank for absorbing the pressure fluctuation of said space on the back surface side is connected via the connecting means, and between said buffer tank and said space in the housing, the oil trapping device, or the oil trapping device connected to a pressure adjusting constriction device is disposed, so that pressure adjustment can be performed in said space on the back surface side of the piston for compressing or expanding the operating gas, and said space in the housing.

5. The Stirling cycle device according to claim 1, wherein an annular pressure-resistant oil seal pressed into contact with said piston rod is disposed as said oil seal in the opening of the top of the crank chamber in addition to said oil sealing bellows, between a space on the back surface side of said piston for compressing or expanding the operating gas, and a seal chamber formed by said oil sealing bellows, a buffer tank for reducing an invalid pressure fluctuation generated on the back surface side of said piston and an invalid pressure fluctuation generated in said seal chamber is connected via connecting means, inside said buffer tank, pressure adjusting bellows are disposed to divide the buffer tank into a chamber on the side of an opening of said pressure adjusting bellows and a chamber on the side of a closing wall, and said chamber on the opening side and the chamber on the closing wall side are connected to either one of said space on the back surface side of the piston and said seal chamber.

6. A Stirling cycle device, comprising:

a housing having a crank chamber;

a cylinder disposed above and adjacent to said crank chamber;

a piston for reciprocating in said cylinder to compress or expand operating gas;

a piston rod operatively connected to a crank in said crank chamber and having one end connected to said piston; and an oil seal disposed in an opening in a top of said crank chamber through which said piston rod is passed, wherein between a space on the side of a back surface of said piston, and a space in said housing, a buffer tank for absorbing a pressure fluctuation in said space on the back surface side and a pressure rise in said housing is connected via connecting means, inside said buffer tank, pressure adjusting bellows are disposed to divide the buffer tank into a chamber on the side of an opening of the pressure adjusting bellows, and a chamber on the side of a closing wall, and said chamber on the opening side and the chamber on the closing wall side are connected to either one of said space on the back surface side of the piston and the space in said housing.

7. A Stirling cycle device, comprising:

a housing having a crank chamber;

a cylinder disposed above and adjacent to said crank chamber;

a piston for reciprocating in said cylinder to compress or expand operating gas;

a piston rod operatively connected to a crank in said crank chamber and having one end connected to said piston; and an oil seal disposed in an opening of a top of said crank chamber through which said piston rod is passed, wherein between a space on the side of a back surface of said piston, and a space in said housing, a buffer tank for absorbing a pressure fluctuation in said space on the back surface side and a pressure rise in said housing is connected via connecting means, and between said buffer tank and said space in the housing, an oil trapping device, or the oil trapping device connected to a pressure adjusting constriction device is disposed, so that pressure adjustment can be performed in said space on the back surface side of the piston for compressing or expanding the operating gas and said space in the housing.

8. A Stirling cycle device, comprising: a housing having a crank chamber;

a cylinder disposed above and adjacent to said crank chamber;

a piston for reciprocating in said cylinder to compress or expand operating gas;

a piston rod operatively connected to a crank in said crank chamber and having one end connected to said piston; and an oil seal disposed in an opening of a top of the crank chamber through which said piston rod is passed, wherein a space on the side of a back surface of said piston, and a space in said housing are connected via an oil trapping device in order to absorb a pressure fluctuation of said space on the back surface side.

9. The Stirling cycle device according to claims 2, 5, or 6 wherein said pressure adjusting bellows comprise one set of bellows, or a pair of opposite type bellows opposite to each other.

10. The Stirling cycle device according to claims 2, 5 or 6, wherein a compression force is applied to the closing wall of said pressure adjusting bellows by a spring.

11. The Stirling cycle device according to claims 2, 5 or 6, wherein said pressure adjusting bellows are guided to the buffer tank by a guide member, and are constituted to smoothly expand and contract without deflecting.

12. The Stirling cycle device according to claims 2, 4, 5, 6, 7, wherein one or two or more buffer tanks are disposed.

13. The Stirling cycle device according to any one of claims 1 to 8 wherein the operating gas of said Stirling cycle device is nitrogen, helium or hydrogen, and cooling heat refrigerant comprises any one gas selected from the group consisting of ethyl alcohol, HFE, PFC, PFG, nitrogen, and helium.

14. The Stirling cycle device according to any one of claims 1 to 8 wherein said Stirling cycle device comprises a compression cylinder having a compression piston, and an expansion cylinder having an expansion piston or a displacer, and said compression piston and said expansion piston or the displacer reciprocate with a phase difference.

15. The Stirling cycle device according to any one of claims 1 to 8, wherein said Stirling cycle device comprises a Stirling cycle refrigerator, or a Stirling cycle engine.

16. The Stirling cycle device according to any one of claims 1 to 8, comprising:

a cylinder block provided with a cylindrical top heat exchange housing having a top wall and a side wall, and an inner cylinder disposed in the top heat exchange housing in which the piston or the displacer slides, wherein in an inner peripheral face on the side of a tip end of said top heat exchange housing, a linear fine groove in an axial direction is formed to form an operating gas channel with an outer peripheral face of said inner cylinder, in the inner peripheral face on the side of a base end of said top heat exchange housing, an annular recess is formed to form a channel for an operating gas regenerator with the outer peripheral face of said inner cylinder, and said top heat exchange housing is formed by lost wax casting.

17. The Stirling cycle device according to claim 16 wherein said top heat exchange housing has a fin formed integrally with said top heat exchange housing in a tip end side outer peripheral face, or a fin separately formed and attached later.

18. The Stirling cycle device according to any one of claims 1 to 8, comprising:

a cylinder block having an inner cylinder in which the piston or the displacer slides, wherein outside said inner cylinder, a cylindrical heat exchanger is disposed which comprises an annular heat exchange housing and a heat exchanger body inserted/fixed inside the housing, a heat exchanging fin is formed in an outer peripheral face of said heat exchanger body, and a linear fine groove in an axial direction is formed in an inner peripheral face to form an operating gas channel with an outer peripheral face of said inner cylinder, a space between said annular heat exchange housing and said heat exchanger body is formed as a refrigerant path, and a refrigerant inlet and a refrigerant outlet are formed in said annular heat exchange housing so that the refrigerant path is connected, said annular heat exchange housing is formed by lost wax casting or iron casting, and said heat exchanger body is formed by the lost wax casting.

19. The Stirling cycle device according to any one of claims 1 to 8, comprising:

a Stirling cycle refrigerator sealing the operating gas and having a cold head and a radiating heat exchanger;

a cooling heat refrigerant pipe line able to be connected to a cooling heat utilizing apparatus for circulating a cooling heat refrigerant from said cold head between said Stirling cycle refrigerator and said cooling heat utilizing apparatus; and a cooling heat refrigerant isothermal fluid storage tank disposed midway in said cooling heat refrigerant pipe line for storing the cooling heat refrigerant, so that a temperature fluctuation of the cooling heat refrigerant by an operating state of said Stirling cycle refrigerator is prevented from directly influencing a cooling temperature of said cooling heat utilizing apparatus.

20. The Stirling cycle device according to claim 19, comprising a temperature adjustment device which performs an operation control of said Stirling cycle refrigerator and/or a control of an electric heater disposed in the cooling heat refrigerant isothermal fluid storage tank to perform a temperature control.

21. The Stirling cycle device according to claim 19 wherein a motor of the Stirling cycle refrigerator is controlled to rotate in reverse so that temperature adjustment, high-temperature heating, or defrosting is performed.

22. The Stirling cycle device according to claim 19 wherein by rotatably disposing an agitating blade in said cooling heat refrigerant isothermal fluid storage tank, a temperature difference of the cooling heat refrigerant in said cooling heat refrigerant Isothermal fluid storage tank is prevented from being generated.

23. The Stirling cycle device according to any one of claims 1 to 8, comprising:

a Stirling cycle refrigerator sealing the operating gas and having a cold head and a radiating heat exchanger;

a cooling heat refrigerant pipe line having both ends connected to said cold head for circulating a cooling heat refrigerant cooled in said cold head;

a secondary cooling heat refrigerant isothermal fluid storage tank in which a secondary cooling heat refrigerant is accommodated and a heat exchange section of said cooling heat refrigerant pipe line is interposed so as to contact the secondary cooling heat refrigerant; and a secondary cooling heat refrigerant pipe line having both ends connected to the secondary cooling heat refrigerant isothermal fluid storage tank and connected to a cooling heat utilizing apparatus for circulating the secondary cooling heat refrigerant between said secondary cooling heat refrigerant isothermal fluid storage tank and the cooling heat utilizing apparatus, so that a temperature fluctuation of the cooling heat refrigerant by an operating state of said Stirling cycle refrigerator is prevented from directly influencing a cooling temperature of said cooling heat utilizing apparatus.

24. The Stirling cycle device according to any one of claims 1 to 8, comprising:

a Stirling cycle refrigerator sealing the operating gas and having a cold head and a radiating heat exchanger;

a cooling heat refrigerant pipe line for passing a cooling heat refrigerant cooled in said cold head, connected to a cooling heat utilizing apparatus, and disposed for circulating the cooling heat refrigerant between the Stirling cycle refrigerator and the cooling heat utilizing apparatus; and a cooling heat refrigerant isothermal fluid storage tank in which said cooling heat refrigerant is accommodated, said cold head is passed from a bottom part, and said stored cooling heat refrigerant is cooled, so that a temperature fluctuation of the cooling heat refrigerant by an operating state of said Stirling cycle refrigerator is prevented from directly influencing a cooling temperature of said cooling heat utilizing apparatus.

25. The Stirling cycle device according to any one of claims 1 to 8, comprising:

a Stirling cycle refrigerator sealing the operating gas and having a cold head for cooling a cooling heat refrigerant and a radiating heat exchanger;

a thermal property test tank for accommodating a test object to be subjected to a thermal property test, and cooled by said cooling heat refrigerant; and a cooling heat refrigerant pipe line for passing the cooling heat refrigerant cooled by said cold head in said thermal property test tank and circulating the cooling heat refrigerant between said cold head and the thermal property test tank, wherein by rotating said Stirling cycle refrigerator forward or in reverse to cool or heat said cooling heat refrigerant, heat shock is applied to the test object and the thermal property test is performed.

26. The Stirling cycle device according to claim 25 wherein a storage case or a stacking shelf for accommodating said test object is disposed in said thermal property test tank.

27. The Stirling cycle device according to claim 25 wherein air, nitrogen or helium is circulated as said cooling heat refrigerant, and said thermal property test is provided with the storage case with a vent hole formed therein for accommodating the test object in the storage case, or is provided with no storage case for accommodating the test object.

28. The Stirling cycle device according to claim 25, comprising a temperature adjustment device for operating/controlling said Stirling cycle refrigerator to perform temperature control.

29. The Stirling cycle device according to claim 25 wherein any one of said thermal property test tank, the cold head and the cooling heat refrigerant pipe line is provided with an electric heater.

30. The Stirling cycle device according to claim 25 wherein by performing control to rotate the motor of said Stirling cycle refrigerator in reverse, the temperature of the thermal property test tank can be raised.

31. The Stirling cycle device according to any one of claims 1 to 8, comprising:

a Stirling cycle refrigerator sealing operating gas, and having a cold head for cooling a cooling heat refrigerant and a radiating heat exchanger;

a thermal property test tank for storing a test object to be subjected to a thermal property test, and cooled by said cooling heat refrigerant; and a cooling heat refrigerant pipe line for passing the cooling heat refrigerant cooled by said cold head so that the cooling heat refrigerant flows around said thermal property test tank and circulates between said cold head and said thermal property test tank, wherein by rotating said Stirling cycle refrigerator forward or in reverse to cool or heat said cooling heat refrigerant, heat shock is applied to the test object and the thermal property test is performed.

32. The Stirling cycle device according to any one of claims 1 to 8, comprising:

a Stirling cycle refrigerator sealing the operating gas, and having a cold head for cooling a cooling heat refrigerant and a radiating heat exchanger; and a thermal property test tank in which a test object to be subjected to a thermal property test is accommodated, and said cold head is disposed to pass through from a bottom part, and cooled by the cold head, wherein by rotating said Stirling cycle refrigerator forward or in reverse to cool or heat said cooling heat refrigerant, heat shock is applied to the test object and the thermal property test is performed.

33. The Stirling cycly device according to any one of claims 1 to 8, comprising:

a Stirling cycle refrigerator sealing operating gas, and having a cold head for cooling a cooling heat refrigerant and a radiating heat exchanger;

a freezing/drying tank in which a heat exchanging coil is disposed in an outer periphery and a material to be dried can be accommodated; and a cooling heat refrigerant pipe line for circulating said cooling heat refrigerant cooled by said cold head between said cold head and said heat exchanging coil, wherin by operating said Stirling cycle refrigerator, passing said cooling heat refrigerant through said heat exchanging coil, and freezing/drying the inside of said freezing/drying tank, the material to be dried is dried.

34. The Stirling cycle device according to claim 33, comprising a temperature adjustment device for operating/controlling the Stirling cycle refrigerator to perform temperature control.

35. The Stirling cycle device according to claim 33 wherein by performing control to rotate the motor of the Stirling cycle refrigerator in reverse, the temperature of said freezing/drying tank can be raised.

36. The Stirling cycle device according to any one of claims 1 to 8, comprising:

a Stirling cycle refrigerator sealing operating gas, and having a cold head for cooling a cooling heat refrigerant and a radiating heat exchanger;

a freezing/drying tank in which a heat exchanging coil is disposed and a material to be dried can be accommodated; and a cooling heat refrigerant pipe line for circulating said cooling heat refrigerant cooled by said cold head between said cold head and said heat exchanging coil, wherein by operating said Stirling cycle refrigerator, passing said cooling heat refrigerant through said heat exchanging coil, and freezing/drying said freezing/drying tank, the material to be dried is dried.

37. The Stirling cycle device according to any one of claims 1 to 8, comprising:

a Stirling cycle refrigerator sealing operating gas, and having a cold head for cooling a cooling heat refrigerant and a radiating heat exchanger;

a freezing/drying tank in which the cooling heat refrigerant is introduced and a material to be dried can be accommodated; and a cooling heat refrigerant pipe line for circulating said cooling heat refrigerant cooled by said cold head between said cold head and the inside of the freezing/drying tank, wherein by operating said Stirling cycle refrigerator, introducing said cooling heat refrigerant into said freezing/drying tank, and performing freezing/drying, the material to be dried is dried.

38. The Stirling cycle device according to any one of claims 1 to 8, comprising:

a Stirling cycle refrigerator sealing operating gas, and having a cold head for cooling a cooling heat refrigerant and a radiating heat exchanger; and a freezing/drying tank in which said cold head is passed through from a bottom part, and a material to be dried can be accommodated, wherein by operating said Stirling cycle refrigerator, and performing freezing/drying, the material to be dried is dried.

39. A Stirling cycle device, comprising: a cylinder block comprising a cylindrical top heat exchange housing having a top wall and a side wall, and an inner cylinder disposed in the top heat exchange housing in which a piston or a displacer slides, wherein a linear fine groove in an axial direction is formed in an inner peripheral face on the side of a tip end of said top heat exchange housing to form an operating gas channel with an outer peripheral face of said inner cylinder, an annular recess is formed in the inner peripheral face on the side of a base end of said top heat exchange housing to form a channel for an operating gas regenerator with the outer peripheral face of said inner cylinder, a cylindrical heat exchanger is disposed outside said inner cylinder, which comprises an annular heat exchange housing and a heat exchanger body inserted/fixed inside the housing, a heat exchanging fin is formed in an outer peripheral face of said heat exchanger body, and a linear fine groove in an axial direction is formed in an inner peripheral face to form the operating gas channel with the outer peripheral face of said inner cylinder, a space between said annular heat exchange housing and said heat exchanger body is formed as a refrigerant path, and a refrigerant inlet and a refrigerant outlet are formed in said annular heat exchange housing so that the refrigerant path is connected, said top heat exchange housing and said heat exchanger body are formed by lost wax casting, and the annular heat exchange housing is formed by the lost wax casting or iron casting.

* * * * *